US005381482A

United States Patent [19]

Matsumoto et al.

[11] Patent Number: 5,381,482

[45] Date of Patent: Jan. 10, 1995

[54] SOUND FIELD CONTROLLER

[75] Inventors: Masaharu Matsumoto, Katano; Mitsuhiko Serikawa, Nishinomiya; Akihisa Kawamura, Hirakata; Hiroko Numazu; Takeshi Norimatsu, both of Kadoma; Ryo Tagami, Hirakata; Mikio Oda, Yawata, all of Japan

[73] Assignee: Matsushita Electric Industrial Co., Ltd., Osaka, Japan

[21] Appl. No.: 12,265

[22] Filed: Feb. 1, 1993

[30] Foreign Application Priority Data

| | | | |
|---|---|---|---|
| Jan. 30, 1992 | [JP] | Japan | 4-014619 |
| Feb. 27, 1992 | [JP] | Japan | 4-040893 |
| Feb. 27, 1992 | [JP] | Japan | 4-040894 |
| Feb. 28, 1992 | [JP] | Japan | 4-042875 |
| Mar. 9, 1992 | [JP] | Japan | 4-050619 |

[51] Int. Cl.[6] ..... H04S 5/02

[52] U.S. Cl. ..... 381/18; 381/63; 381/1

[58] Field of Search ..... 381/1, 63, 17, 18

[56] References Cited

U.S. PATENT DOCUMENTS

| | | | |
|---|---|---|---|
| 4,633,495 | 12/1986 | Schotz . | |
| 4,817,149 | 3/1989 | Myers | 381/1 |
| 4,841,572 | 6/1989 | Klayman . | |
| 4,866,648 | 9/1989 | Usui . | |
| 4,980,914 | 12/1990 | Kunungi et al. | 381/1 |
| 5,052,685 | 10/1991 | Lowe et al. . | |
| 5,065,433 | 11/1991 | Ida et al. | 381/63 |
| 5,105,462 | 4/1992 | Lowe et al. | 381/17 |

FOREIGN PATENT DOCUMENTS

| | | |
|---|---|---|
| 0228851 | 7/1987 | European Pat. Off. . |
| 2145100 | 4/1990 | Japan . |
| 3241400 | 10/1991 | Japan . |
| 9120164 | 12/1991 | WIPO . |

*Primary Examiner*—Forester W. Isen
*Attorney, Agent, or Firm*—Ratner & Prestia

[57] ABSTRACT

A sound field controller for generating apparent sound sources by adjusting the amplitude and delay time of a sound signal so that the sound will be perceived by plural listeners as sound coming from a location separated from the specific location of the front speakers, and for additionally controlling the effect of the apparent sound sources by evaluating the attributes of the source sound signal. The controller includes FIR filters for generating a left sound pattern signal, FIR filters for generating a right sound pattern signal, a first delay circuit for delaying the left and right sound pattern signals by a first predetermined time and applying the delayed left and right sound pattern signals to the left and right speakers, respectively, to introduce an apparent sound source located left rear of a center listener; and a second delay circuit for delaying the left and right sound pattern signals by a second predetermined time and applying the delayed left and right sound pattern signals to the right and left speakers, respectively, to introduce an apparent sound source located right rear of a center listener.

8 Claims, 12 Drawing Sheets

ML(t)
MR(t)
2
3
SSG
1
S(t)
A/D
21
S(n)
11-1
12-1
11
12
13
14
13-1
14-1
FIR h1L(n)
FIR h1R(n)
FIR hL(n)
FIR hR(n)
FIR hL(n)
FIR hR(n)
FIR h1L(n)
FIR h1R(n)
15-1
16-1
15
16
17
18
17-1
18-1
DLY (50ms)
DLY (63ms)
DLY (20ms)
DLY (30ms)
DLY (30ms)
DLY (20ms)
DLY (50ms)
DLY (63ms)
22-1
23-1
22
23
24
25
24-1
25-1
D/A
19
4
20
6
8-1
8
8-2
LL
CL
CR
RR

ML(t)
MR(t)
2
3
SSG
1
S(t)
A/D
21
S(n)
DLY (20ms)
40
11-1
14-1
11
14
FIR h1L(n)
FIR h1R(n)
FIR hL(n)
FIR hR(n)
41
32-1
33-1
42
32
33
DLY (43ms)
DLY (30ms)
DLY (30ms)
DLY (43ms)
DLY (0.7ms)
DLY (0.7ms)
22-1
23-1
24-1
25-1
22
23
24
25
D/A
FOR LL
FOR CL
FOR RR
FOR CR
19
4
20
6
8-1
8
8-2
LL
CL
CR
RR

ML(t)
MR(t)
2
3
SSG
1
S(t)=ML(t)−MR(t)
A/D
21
S(n)
PHASE
51
−{ML(t)−MR(t)}
ML(t)−MR(t)
FIR h1L(n)
11-1
FIR h1R(n)
14-1
FIR hL(n)
11
FIR hR(n)
14
32-1
33-1
32
33
DLY (30ms)
DLY (30ms)
DLY (0.7ms)
DLY (0.7ms)
22-1
23-1
24-1
25-1
22
23
24
25
D/A
FOR LL
FOR CL
FOR RR
FOR CR
19
4
20
6
8-1
LL
8
CL
CR
8-2
RR

ML(t)
MR(t)
2
3
SSG
1
S(t)
A/D
21
S(n)
FIR hL(n)
4-11
FIR hR(n)
4-12
4-13
4-14
ShL(n)
ShR(n)
DLY t1 (0.7ms)
DLY t1 (0.7ms)
4-15
4-16
ShR(n-t1)
ShL(n-t1)
4-17
4-18
DLY t2
ADJ
DLY t3
4-24
4-20
4-25
D/A
D/A
4-26
4-27
4
6
8-1
8
8-2
LL
CL
CR
RR

ML(t)
MR(t)
SSG
1
2
3
S(t)
A/D
21
S(n)
4-13
4-14
4-11
FIR hL(n)
DLY t1 (0.7ms)
DLY t1 (0.7ms)
FIR hR(n)
4-12
4-15
4-16
4-17
SL(n)
SR(n)
DLY t2 (0.7ms)
4-19
4-20-1
4-19-2
4-20
DLY t2 (0.7ms)
4-18
DLY t3 (20ms)
DLY t4 (63ms)
DLY t5 (50ms)
DLY t3 (20ms)
DLY t4 (63ms)
DLY t5 (50ms)
4-19-1
SL(n-t4)
SR(n-t4)
4-20-2
SL(n-t2-t3)
SL(n-t5)
SR(n-t3)
SR(n-t2-t5)
4-22
D/A
4-24
4-25
D/A
4-23
4-26
4-27
4
6
8-1
8
8-2
LL
CL
CR
RR

SOUND FIELD CONTROLLER

BACKGROUND OF THE INVENTION

1. Field of the invention

The present invention relates to a sound field controller for reproducing sound effects for use in audio equipments or in audio-visual (AV) equipments.

2. Description of the prior art

As VCR decks have become a common household item and rental video tapes easily available for home viewing, consumer interest in large-screen televisions and audio equipment capable of theater-like sound presence has grown. Audio-visual equipment manufacturers have therefore developed hardware to meet this interest, commonly incorporating the Dolby ® Surround-Sound TM format using side speakers, rear speakers, or a combination of these to re-create a theater-like sound presence from the sound track on movie videos.

Conventional sound field controllers using the Dolby ® Surround-Sound TM format to reproduce this theater-like sound presence in the home are commonly called "surround processors." These surround processors function using audio recordings made with the "surround sound" signal to be reproduced through speakers set to the rear (or sides) encoded to the standard two-channel stereo sound signal. The surround processor is used as a decoder to decode the surround sound signal during playback for reproduction through the two rear (or one rear) speakers. The standard stereo signal is, of course, reproduced through the two speakers at the front right and left of the listener(s).

Compared with the normal stereo sound system using two front speakers, this sound field controller can reproduce sound with a fuller three-dimensional presence because sounds heard from the front speakers and other sounds that cannot be heard with just the front speakers can be heard from the rear speakers. The drawback to this system is the need for additional sound reproduction means, i.e., speakers, at the sides or rear to reproduce the surround sound, as well as the additional space needed to place the speaker(s).

SUMMARY OF THE INVENTION

Therefore, an object of the present invention is to provide a sound field controller wherein the reproduced sound can be heard as sound coming not only from front, but also from sides or rear using only the front speakers, so that the reproduced sound can be heard more naturally as sound coming from a location other than the location of the speakers located only at the front.

More specifically, an object of the present invention is to provide a sound field controller using only the front speakers to produce apparent sound sources behind the listeners not only at the center of the two speakers, but also at locations deviated to the left of right of the center, so as to widen the service area of the surround sound effect.

To achieve this object, a sound field controller for controlling sound field by left and right speakers provided in front of one or more listeners, comprises: input means for providing one sound signal; left sound pattern generating means for generating a left sound pattern signal hL(n); right sound pattern generating means for generating a right sound pattern signal hR(n); first delay means for delaying said left and right sound pattern signals by a first predetermined time and applying the delayed left and right sound pattern signals to said left and right speakers, respectively, to introduce an apparent sound source located left rear of a center listener; and second delay means for delaying said left and right sound pattern signals by a second predetermined time and applying the delayed left and right sound pattern signals to said right and left speakers, respectively, to introduce an apparent sound source located right rear of a center listener.

According to the present invention, the sound field controller further comprises: further-left sound pattern generating means for generating a further-left sound pattern signal h1L(n); further-right sound pattern generating means for generating a further-right sound pattern signal h1R(n); third delay means for delaying said further-left and further-right sound pattern signals by third and fourth predetermined times, respectively, and applying the delayed further-left and further-right sound pattern signals to said left and right speakers, respectively, to introduce an apparent sound source located left rear of a left listener; and fourth delay means for delaying said further-left and further-right sound pattern signals by said fourth and third predetermined times, respectively, and applying the delayed further-left and further-right sound pattern signals to said right and left speakers, respectively, to introduce an apparent sound source located right rear of a right listener.

BRIEF DESCRIPTION OF THE DRAWINGS

The present invention will become more fully understood from the detailed description given below and the accompanying diagrams wherein.

DESCRIPTION OF PREFERRED EMBODIMENTS

The preferred embodiments of the present invention are described hereinbelow with reference to the accompanying figures.

First Embodiment

Figure 1:
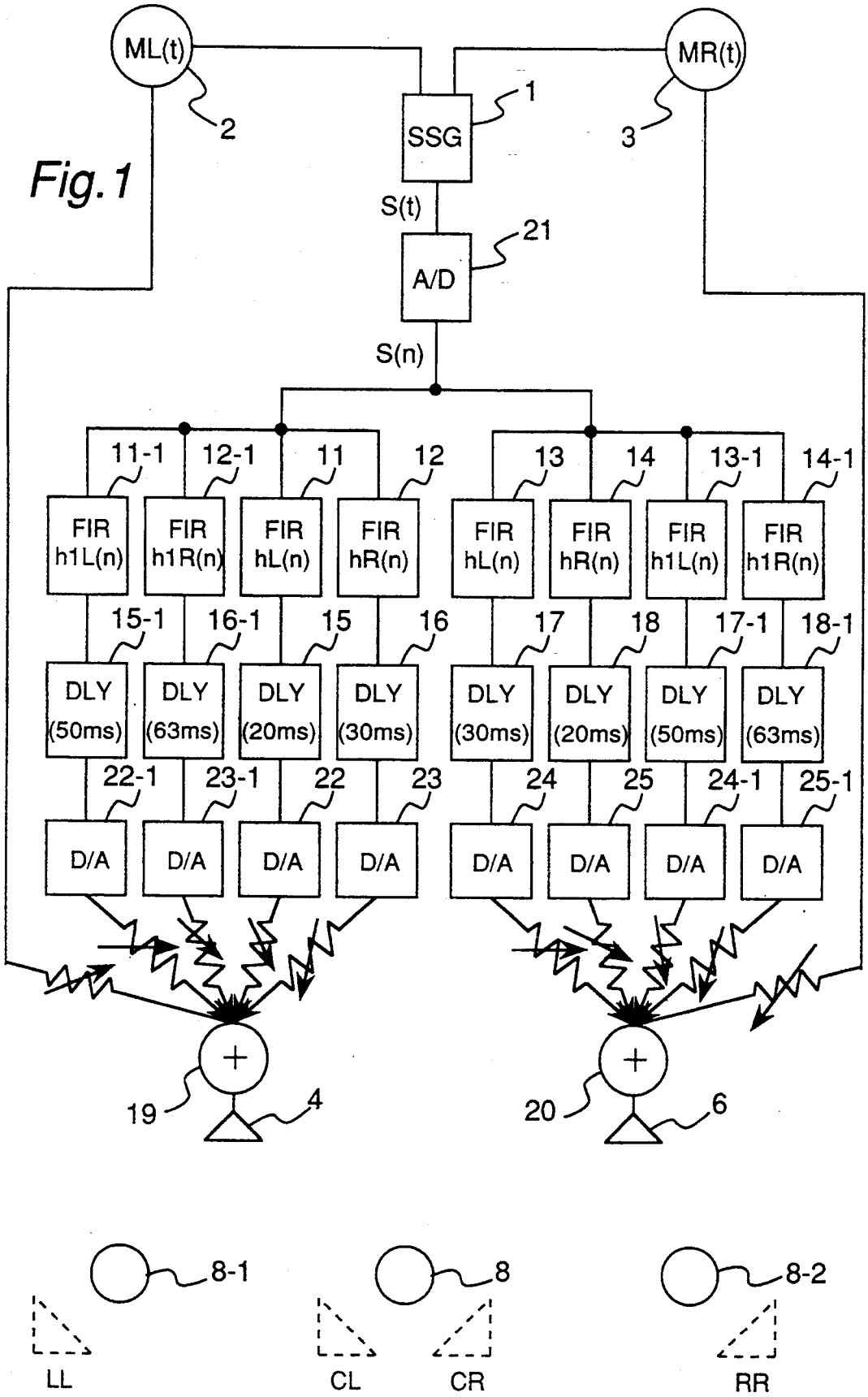
FIG. 1 is a block diagram of a sound field controller according to a first embodiment of the present invention.

FIG. 1 shows a block diagram of a sound field controller according to the first embodiment. In the following descriptions of the invention it is assumed that there are three listeners, the center listener 8, a second listener 8-1 on the left side of the center listener 8, and a third listener 8-2 on the right side of the center listener 8. The signal ML(t) 2 to be reproduced from the left channel speaker 4 relative to the center listener 8 position, and the signal MR(t) 3 to be reproduced from the right channel speaker 6 relative to the center listener 8 position are input to the surround signal generator 1.

The surround signal generator 1 generates the surround signal S(t) containing the reverberation sound, reflected sound, and other effect sounds that are to be reproduced at a point behind the listeners by processing the two input signals ML(t) 2 and MR(t) 3.

An analog/digital (A/D) converter 21 for converting the analog surround signal S(t) to a digital signal is connected to the surround signal generator 1. The output of the A/D converter 21 is split into two lines, which are further split into four lines each.

These split signals are input to finite impulse response (FIR) filters 11, 12, 13, 14, 11-1, 12-1, 13-1, and 14-1.

FIR filters 11 and 13 produce the same impulse response signal hL(n); FIR filters 12 and 14 produce the same impulse response signal hR(n); FIR filters 11-1 and 13-1 produce the same impulse response signal h1L(n); and FIR filters 12-1 and 14-! produces the same impulse response signal h1R(n). Therefore, there are four different impulse response signals hL(n), hR(n), h1L(n) and h1R(n). As will be described later, when signals hL(n) and hR(n) are applied to left and right speakers 4 and 6, respectively, an apparent sound source CL at the left and left rear sides of the center listener 8 is introduced. When signals hL(n) and hR(n) are applied in opposite relationship to the above, i.e., to right and left speakers 4 and 6, respectively, an apparent sound source CR at the right and right rear sides of the center listener 8 is introduced. When signals h1L(n) and h1R(n) are applied to left and right speakers 4 and 6, respectively, an apparent sound source LL at the left and left rear sides of the left listener 8-1 is introduced. When signals h1L(n) and h1R(n) are applied in opposite relationship to the above, i.e., to right and left speakers 4 and 6, respectively, an apparent sound source RR at the right and right rear sides of the right listener 8-2 is introduced. The above mentioned relationship is shown in Tables 1 and 2 below.

TABLE 1

| Signals | Apparent Sound Source CL | Apparent Sound Source CR |
|---|---|---|
| hL(n) | Left Speaker 4 | Right Speaker 6 |

TABLE 1-continued

| Signals | Apparent Sound Source CL | Apparent Sound Source CR |
|---|---|---|
| hR(n) | Right Speaker 6 | Left Speaker 4 |

TABLE 1

| Signals | Apparent Sound Source LL | Apparent Sound Source RR |
|---|---|---|
| h1L(n) | Left Speaker 4 | Right Speaker 6 |
| h1R(n) | Right Speaker 6 | Left Speaker 4 |

The output of each of the FIR filters 11, 12, 13, 14, 11-1, 12-1, 13-1, and 14-1 is connected to a corresponding delay circuit 15, 16, 17, 18, 15-1, 16-1, 17-1, and 18-1. Each delay circuit is composed of a circulating storage means such as a DRAM, and function to delay the digital signals input thereto by a given time.

In the delay circuit 15, 16, 17, 18, 15-1, 16-1, 17-1, and 18-1, the delay times may be 20 milliseconds, 30 milliseconds, 50 milliseconds and 63 milliseconds, respectively. Therefore, the sounds from the apparent sound source CL as generated by FIRs 11 and 14 delay 20 ms from the sounds generated directly by input signals ML(t) 2 and MR(t) 3. The sounds from apparent sound source CR as generated by FIRs 12 and 13 delay 10 ms from the sounds from the apparent sound source CL. The sounds from apparent sound source LL as generated by FIRs 11-1 and 14-1 delay 20 ms from the sounds from the apparent sound source CR. The sounds from apparent sound source RR as generated by FIRs 12-1 and 13-1 delay 13 ms from the sounds from the apparent sound source LL. Since there are time differences between the sounds from sound sources CL, CR, LL and RR, each listener at different locations can discriminate the sounds coming from different sound sources. A good difference between the right and left channel delay times is approximately 10 ms, and between the main signals ML(t) and MR(t) and the surround signal S(t) is approximately 20 ms. The delay times given above and elsewhere are only examples, and can be varied.

The outputs of the delay circuit 15, 16, 17, 18, 15-1, 16-1, 17-1, and 18-1 are input to digital/analog (D/A) converters 22, 23, 24, 25, 22-1, 23-1, 24-1, 25-1, respectively for converting the processed digital signals to analog signals. The outputs of D/A converters 22, 23, 22-1, and 23-1 are applied, together with the main signal ML(t) 2, to the left-channel adder 19, and outputs of D/A converters 24, 25, 24-1, and 25-1 are applied, together with the main signal MR(t) 3, to the right channel adder 20. A variable resistor may be inserted in each line connected to each of the adders 19, 20 so that the respective plural input signals are added at a desired ratio. Such variable resistors may be provided any of the other embodiments. The outputs of the adders 19, 20 are applied to the speakers 4 and 6 positioned in front of the listeners 8, 8-1, and 8-2.

The method of orienting the reproduced sound to the left and left rear side of the center listener 8 using just the front speakers 4 and 6 is described below with reference to FIG. 2.

Referring to FIGS. 2, 3*a*, 3*b*, 3*c* and 3*d*, principle of the FIR filter will be explained. To this end, the description is particularly directed to FIR filters 11 and 14 to which the surround signal S(t) from A/D converter 21 is applied.

Figure 2:
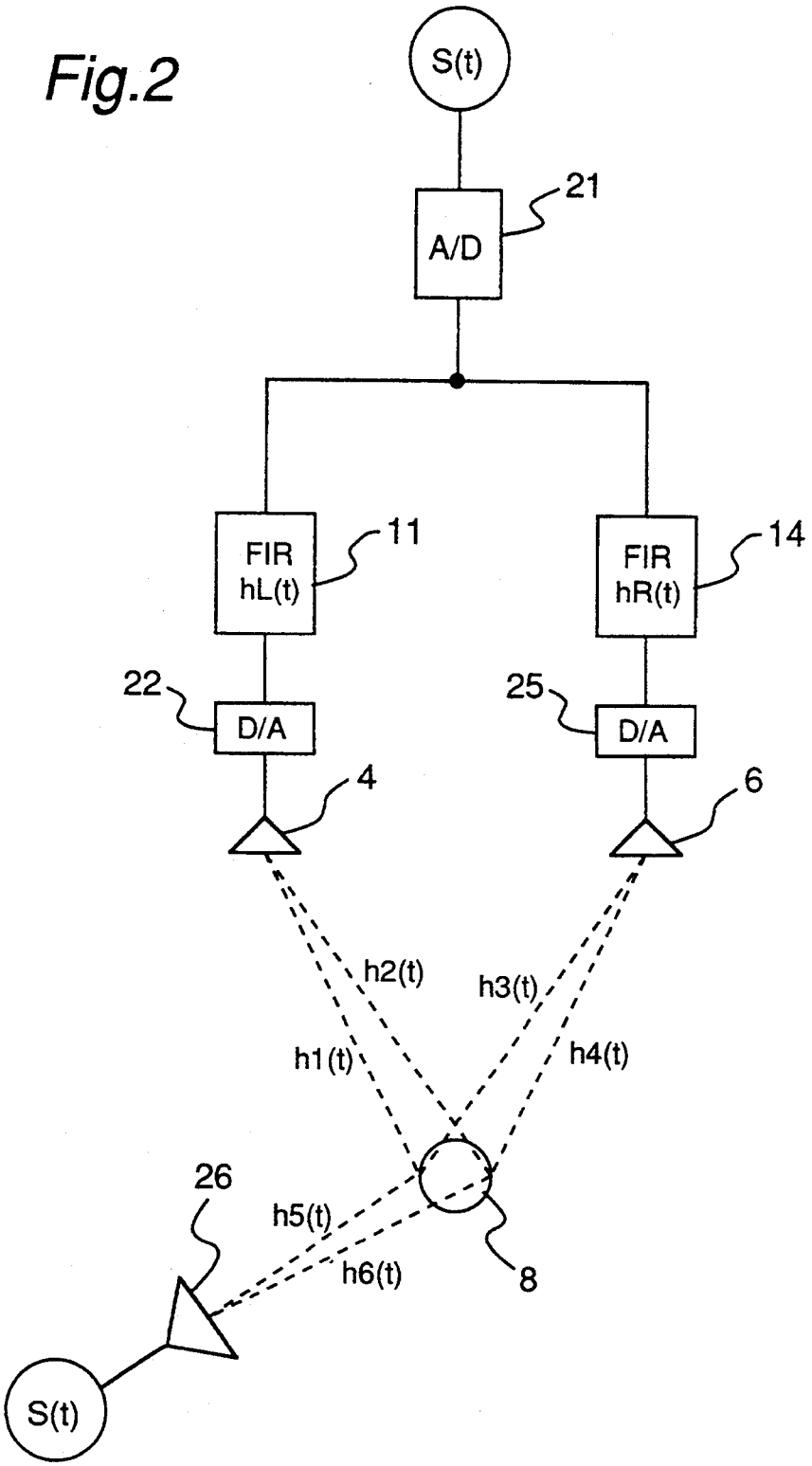
FIG. 2 is a block diagram used to describe the principle of the two speaker surround sound system applied by the first embodiment.

In FIG. 2, h1(t) represents the head related transfer function (hereinafter referred to as the impulse response to explain the invention in the time domain, although the frequency domain could also be used for description) of the left ear of the center listener 8 with respect to the impulse signal (FIG. 3*b*) from the left channel speaker 4. More precisely, h1(t) is the response at the ear drum of the left ear when the left channel speaker 4 produces an impulse sound (FIG. 3*b*). The measurements are taken at the entrance to the ear canal. Similarly, h2(t) represents the impulse response of the right ear of the center listener 8 with respect to the impulse signal from the left channel speaker 4, h3(t) represents the impulse response of the left ear of the center listener 8 with respect to the impulse signal from the right channel speaker 6, and h4(t) represents the impulse response of the right ear of the center listener 8 with respect to the impulse signal from the right channel speaker 6.

Further, in the model shown in FIG. 2, an actual left rear speaker 26 is provided to measure h5(t) representing the impulse response of the left ear of the center listener 8 with respect to the impulse signal from the left rear speaker 26, and h6(t) representing the impulse response of the right ear of the center listener 8 with respect to the impulse signal from the left rear speaker 26.

With this configuration, the sound patterns L(t) and R(t) reaching left and right ears of the center listener 8 when the surround signal S(t) is emitted from the rear speaker 26 are defined by equations (1) and (2), respectively, $$L(t)=S(t)*h5(t) \quad (1)$$

$$R(t)=S(t)*h6(t) \quad (2)$$

where (*) represents a transformation (convolution) operation. In practice the transfer function of the speaker itself is multiplied, but this is ignored. Alternatively, the transfer functions of the speakers may be thought of as being included in h5(t) and h6(t).

In addition, if time is treated as a discrete digital signal and the impulse response and surround signal S(t) are expressed as L(t)→L(n)
R(t)→R(n)
h5(t)→h5(n)
h6(t)→h6(n)
S(t)→S(n)

where n is actually nT of which T is the sampling time, nT is generally expressed with the T omitted, and n is an integer greater than zero, then equations (1) and (2) above can be rewritten as $$L(n) = S(n)*h5(n) = \sum_{k=0}^{N-1} S(k)*h5(n-k)$$

$$R(n) = S(n)*h6(n) = \sum_{k=0}^{N-1} S(k)*h6(n-k)$$

where N is the time length of the impulse response h5(n) and h6(n).

Similarly, the sound patterns L'(t) and R'(t) reaching left and right ears of the center listener 8 when the surround signal S(t) is emitted from the left channel speaker and right channel speaker 6 are defined by equations (3) and (4), respectively.

$$L'(t)=S(t)*hL(t)*h1(t)+S(t)*hR(t)*h3(t) \quad (3)$$

$$R'(t)=S(t)*hL(t)*h2(t)+S(t)*hR(t)*h4(t) \quad (4)$$

Expressed in time domain for digital signals as above, these equations become:

$$L'(n)=S(n)*hL(n)*h1(n)+S(n)*hR(n)*h3(n) \quad (5)$$

$$R'(n)=S(n)*hL(n)*h2(n)+S(n)*hR(n)*h4(n) \quad (6)$$

If it is assumed that sounds will be perceived as coming from the same direction when the head related transfer functions are equal (determination of the direction from which sound is coming is based on the amplitude difference and time difference between the sounds reaching the right and left ears, and is generally correct), then equations (7) and (9) will be true.

$$L(n)=L'(n) \quad (7)$$

$$R(n)=R'(n) \quad (9)$$

As a result, it will be sufficient to process hL(n) and hR(n) so that the equations $$h5(n)=hL(n)*h1(n)+hR(n)*h3(n) \quad (8)$$

$$h6(n)=hL(n)*h2(n)+hR(n)*h4(n) \quad (10)$$

are true.

For example, if equations (8) and (10) are rewritten in a frequency domain expression, the transformation function becomes a multiplication operation, and the respective impulse responses are transformed by FFT (Fast Fourier Transformer) to a transfer function. Because the transfer functions other than the transfer functions of FIR filters 11 and 14 are obtained by measurement, the transfer functions of FIR filters 11 and 14 can be obtained from equations (8) and (10).

More specifically, when equations (8) and (10) are rewritten in the frequency domain expression by FFT, $$H5=HL\cdot H1+HR\cdot H3 \quad (8')$$

$$H6=HL\cdot H2+HR\cdot H4 \quad (10')$$

are obtained, wherein H indicates that FFT has been carried out, for example, H5 is a FFT transferred expression of h5(n). Thus, $$HL=(H5\cdot H4-H6\cdot H3)/(H1\cdot H4-H2\cdot H3) \quad (8\text{-L})$$

$$HR=(H5\cdot H2-H6\cdot H1)/(H3\cdot H2-H4\cdot H1) \quad (8\text{-R})$$

are obtained. When equations (8-L) and (8-R) are again rewritten in the time domain expression by IFFT (Inverse Fast Fourier Transformer), $$hL(n)=hL(0)+hL(1)+\ldots+hL(N-1) \quad (8\text{-L}')$$

$$hR(n)=hR(0)+hR(1)+\ldots+hR(N-1) \quad (8\text{-R}')$$

are obtained. For a certain surround signal S(n), hL(n) can be given by the waveform shown in FIG. 3*c*, and hR(n) can be given by the waveform shown in FIG. 3*d*.

Using the resulting signal values hL(n) and hR(n), hL(n) can be convoluted with the surround signal S(n) into the signal output by the left channel speaker 4, and hR(n) can be convoluted with the surround signal S(n)

into the signal output by the right channel speaker 6. As a result, the sound heard by the center listener 8 will also seem to be coming from a point behind the center listener 8 even though the rear speaker 26 is not actually played. In this manner, the apparent sound source CL is introduced. Other apparent sound sources CR, LL and RR are introduced in a similar manner.

Note that it is the FIR filters 11 and 14 performing the actual convolution operation to calculate equations (8-L') and (8-R'). An example of the FIR filter 11 is shown in FIG. 3*a*.

Figure 3A:
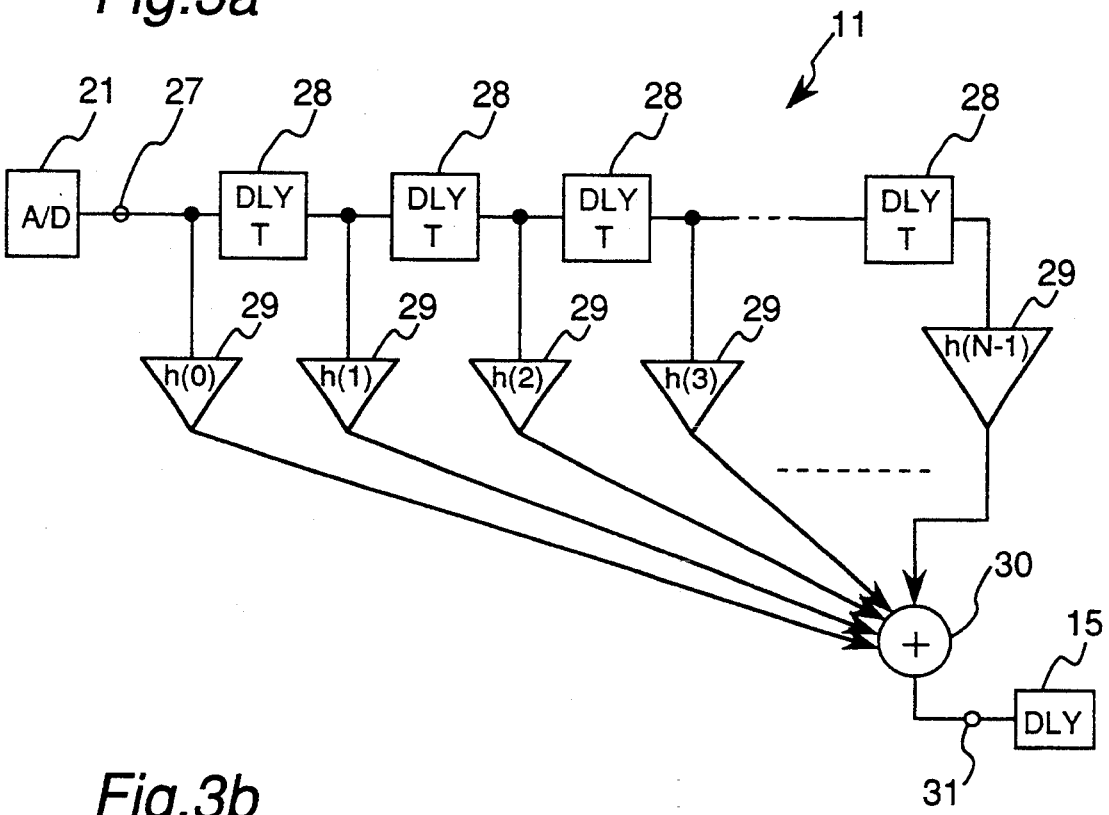
FIG. 3*a* is a block diagram of the FIR filter used in the embodiments.
Figure 3B:
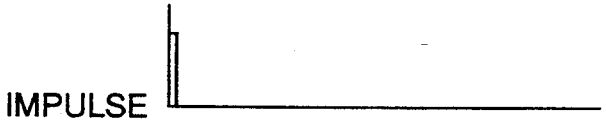
FIG. 3*b* is a waveform of an impulse.
Figure 3C:
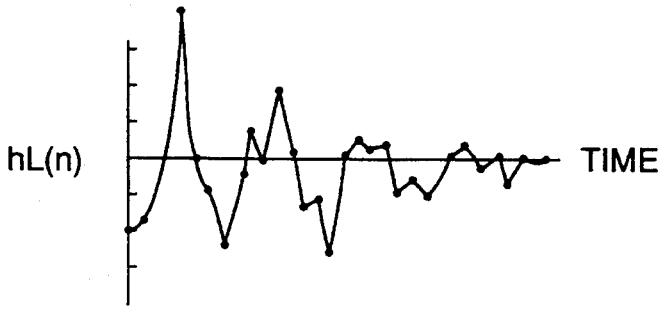
FIG. 3*c* is a waveform of an impulse response observed at left ear of the listener 8 shown in FIG. 2.
Figure 3D:
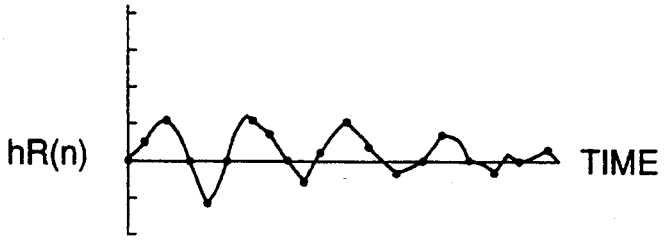
FIG. 3*d* is a waveform of an impulse response observed at right ear of the listener 8 shown in FIG. 2.

Referring to FIG. 3*a*, the input signal to the FIR filter 11 is applied to the input terminal 27 and through a serially connected N−1 delay elements 28, each delays the signal by a sampling time T. N multipliers 29 are connected to the input of the first delay element and outputs of all the delay elements 28, respectively, to multiply the input signal by the respective amplification factor which is also called tap coefficient. The outputs of the multipliers 29 are connected to an adder 30, which adds all of the input signals and outputs the sum signal through the output terminal 31. Thus, the output from terminal 31 will have a waveform, such as shown in FIG. 3*c*. The waveform varies as the change of the surround signal S(n).

The tap coefficient h(n) (n: 0 through N−1) of the 25 multipliers 29 is the impulse response with known set characteristics. Although FIR filter 11 shown in FIG. 3*a* is formed by hardware, FIR filters are formed by software using a digital signal processor (DSP) or dedicated LSI device for high speed multiplication and addition operations. As shown in the figure, the impulse response h(n) is set as the tap coefficient of the multipliers 29, and a delay time corresponding to the sampling frequency when the analog signal is converted to a digital signal is set in the delay elements 28. The transformation operation shown in equations (1) and (2) is performed by repeating the multiply/add/delay operation on the input signals. By thus inputting a signal to the FIR filter, the impulse response h(n) characteristics are convoluted into the input signal, and the transformed result is output.

It is to be noted that FIR filters other than 11 are formed in the similar manner described above.

The operation of the first embodiment thus configured is described below.

The two-channel signal ML(t) 2, MR(t) 3 reproduced by the VCR player or other audio playback device is input to the surround signal generator 1, which generates the surround signal S(t) containing the sound reverberation, sound reflection, and other effect sounds that are to be reproduced at a point behind the listeners by performing sum and difference operations on the input signals. The resulting surround signal S(t) is then converted to a digital signal S(n) by the A/D converter 21. The surround signal S(n) is then input to the FIR filters 11 and 14 of which the tap coefficients are the impulse responses hL(n) and hR(n) needed to orient the sound to the left and left rear sides of the center listener 8 (thus introducing the apparent sound source CL) when hL(n) and hR(n) are applied respectively to left and right speakers. The surround signal S(n) is also input to the FIR filters 11-1 and 14-1 of which the tap coefficients are the impulse responses h1L(n) and h1R(n) needed to orient the sound to the left and left rear sides of the second listener 8-1 (thus introducing the apparent sound source LL) when h1L(n) and h1R(n) are applied respectively to left and right speakers.

Similarly, the surround signal S(n) is input to the FIR filters 12 and 13 of which the tap coefficients are the impulse responses hR(n) and hL(n) needed to orient the sound to the right and right rear sides of the center listener 8 (thus introducing the apparent sound source CR) when hL(n) and hR(n) are applied respectively to right and left speakers. It is noted that the signals applied to the left and right speakers are opposite to the above. The surround signal S(n) is also input to the FIR filters 12-1 and 13-1 of which the tap coefficients are the impulse responses h1R(n) and h1L(n) needed to orient the sound to the right and right rear sides of the third listener 8-2 (thus introducing the apparent sound source RR) when h1L(n) and h1R(n) are applied respectively to right and left speakers.

To produce appropriate impulse responses to the input surround signal S(n), each FIR filter perform the convolution operation after every calculation cycle.

It is to be noted that while the impulse response needed to orient the sound to the right side is obtained by reversing the left side data, the impulse response that orients the sound to the right side can also be obtained by calculation.

After processing the surround signal S(t) to orient the sound to the left and right sides of the three listeners 8, 8-1, and 8-2, the signal is delayed by the delay circuit 15, 16, 17, 18, 15-1, 16-1, 27-1, and 18-1 so that the sound reaches the right and left sides of the listeners at different times. It is thus possible to separate the signals by applying different time differences to the signals, making it possible to clarify the sound presence to the sides or rear of the listeners. (Note that this "sound presence" is the vague perception of a sound source to the sides or back of the listener, and does not indicate the location of a clearly defined sound image as in the common usage of the term ).

The delay circuit 15, 16, 17, 18, 15-1, 16-1, 17-1, and 18-1 output signals are input to the D/A converters 22, 23, 24, 25, 22-1, 23-1, 24-1, 25-1 for conversion from digital to analog signals. The converted analog signals are then input together with the main signals ML(t) 2 and MR(t) 3 to the adders 19, 20, added, and output from the speakers 4, 6. The sound reproduced by the speakers 4, 6 can be modified for enhanced ambiance, realism, or to match listener preferences by changing the ratio using variable resistors.

For example, to enhance the sound experience of the center listener 8 relative to the other listeners 8-1 and 8-2, deterioration of the sound effect perceived by the center listener 8 can be prevented by adding less of the output signals from D/A converters 22-1, 23-1, 24-1, and 25-1 than the output signals from D/A converters 22, 23, 24, and 25. This is because the signals locating the sound to the left or right side of the center listener 8 are the same signals locating the sound in front of the second listener 8-1 and third listener 8-2, and sounds located to the left or right sides of the second and third listeners will be perceived as being located in front of the center listener 8. This is avoided by the delay circuit 15, 16, 17, 18, 15-1, 16-1, 17-1, and 18-1.

As thus described, a surround signal can be reproduced as sound coming from the sides and/or back of plural listeners 8, 8-1, 8-2 in different locations using only two front speakers 4, 6 by processing the surround signal so that it is perceived as a sound originating from a source to the sides or back of the listeners and applying a time difference to the surround signal S(t) output from the front right and left sound reproduction means.

By combining this surround signal with the main signals, sound can be reproduced with a live presence perceived by plural listeners located throughout a broad listening area.

It is to be noted that the surround signal processed as the sound signal in this embodiment is split into eight signals, and eight adjustment means and eight delay circuit are used to process the signals. The invention shall not be so limited, and any number of sound signal splitters, adjustment means, and delay circuit may be used so long as there are at least four each.

Furthermore, the first embodiment was described using two front speakers, but the invention shall not be so limited and three or more front speakers may also be used.

Second Embodiment

Figure 4:
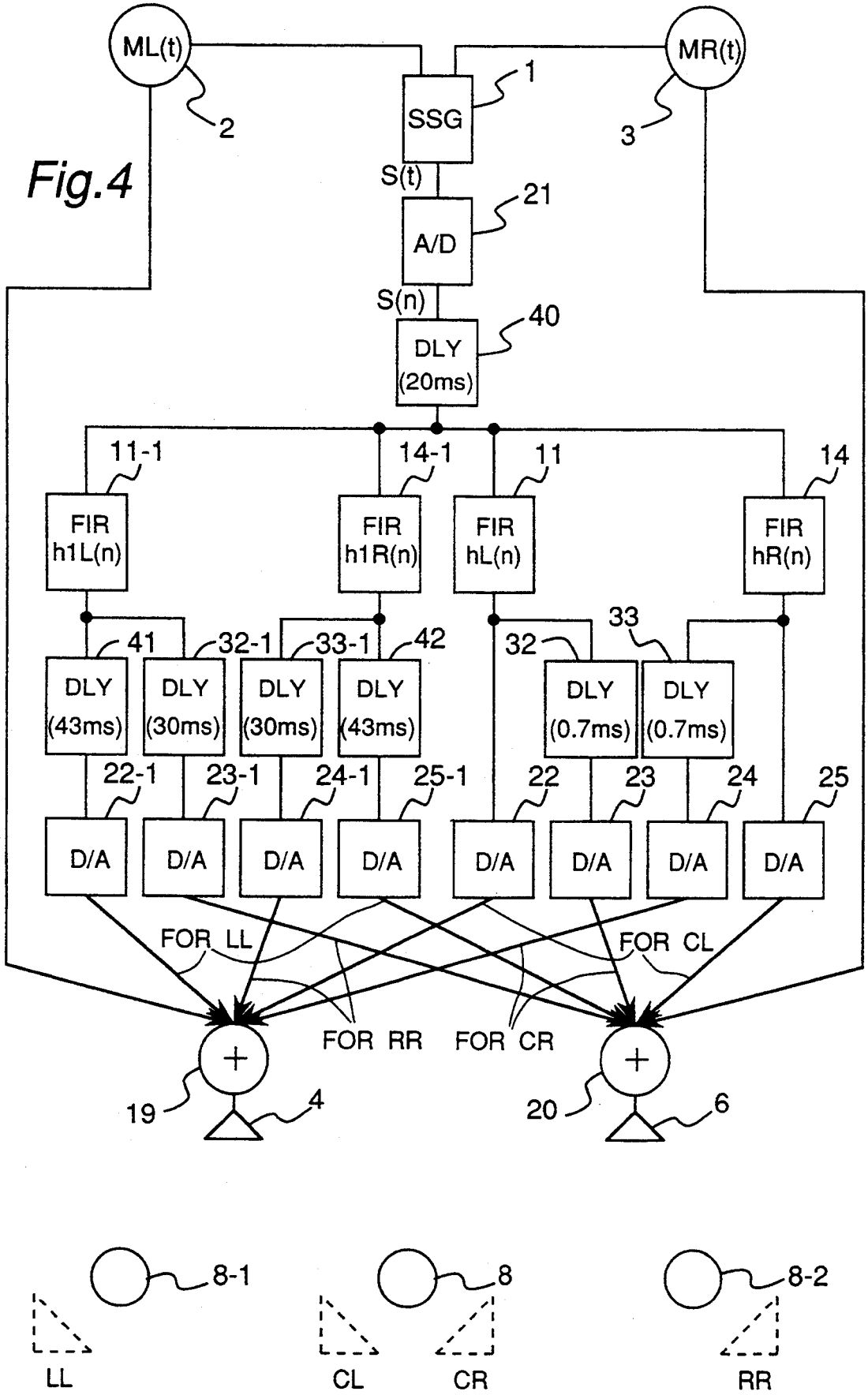
FIG. 4 is a block diagram of a sound field controller according to a second embodiment of the present invention.

FIG. 4 is a block diagram of a sound field controller according to the second embodiment of the present invention.

As shown in FIG. 4, it is also assumed that there are three listeners 8, 8-1, and 8-2 with two speakers 4 and 6 placed in front of the listeners. The two main signals ML(t) and MR(t) 3 are input to the surround signal generator 1. An analog/digital (A/D) converter 21 is connected to the surround signal generator 1.

The output of the A/D converter 21 is applied to a delay device 40 for delaying, e.g., 20 ms, the digitized surround signal S(n), and the output of the delay device 40 is then split into four signals.

These split signals are input to FIR filters 11, 14, 11-1, and 14-1. FIR filters 11 and 14 process the input signals to introduce apparent sound sources CL and CR so that the sound of the signals input thereto is oriented to the left and left rear sides of the center listener 8. FIR filters 11-1 and 14-1 process the signals to introduce apparent sound sources LL and RR so that the sound is oriented to the left and left rear sides of the second and third listeners 8-1 and 8-2.

The output from each of the FIR filters 11, 14, 11-1, and 14-1 is then further split into two signals. One of the split output signals is input directly to the corresponding D/A converters 22, 25, and the other is input to the corresponding delay circuit 32, 33, 32-1, 33-1, 41 and 42. The outputs from the delay circuit 32, 33, 32-1, 33-1, 41 and 42 are input to the D/A converters 23, 24, 23-1, 24-1, 22-1 and 25-1, respectively. The outputs of D/A converters 22, 24, 22-1, and 24-1 and the main signal ML(t) 2 are input to the first adder 19, and the outputs of D/A converters 23, 25, 23-1, and 25-1 and the other signal MR(t) 3 are input to the second adder 20. The adders 19, 20 are connected, respectively, to the left and right speakers 4 and 6.

As in the first embodiment above, the values hL(n) and hR(n) of FIR filters 11 and 14, and h1L(n) and h1R(n) of FIR filters 11-1 and 14-1 are the impulse response to the center listener 8 and second listener 8-1. According to the second embodiment shown in FIG. 4, the delay device 40 delays 20 ms, each of delay circuits 32 and 33 delays 0.7 ms, each of delay circuits 32-1 and 33-i delays 30 ms, and each of delay circuits 41 and 42 delays 43 ms.

The operation of this embodiment is described below with reference to FIG. 4.

The surround signal S(t) is input to the A/D converter 21, which converts the input to a digital surround signal S(n) and outputs the result to the delay device 40. The delay device 40 delays the surround signal S(n) relative to the main signals ML(t) 2 and MR(t) 3 by a preselected amount, e.g., 20 msec. The delay device 40 output signal is then split into four signals, which are input to the FIR filters 11 and 14 with an impulse response characteristic hL(n) and hR(n) causing the output sound to be oriented to the left and back left of the center listener 8, and to the FIR filters 11-1 and 14-1 with an impulse response characteristic h1L(n) and h1R(n) causing the output sound to be oriented to the left and back left of the second listener 8-1.

The signals processed by the FIR filters 11, 14, 11-1 and 14-1 are then split into two signals each. One of the split output signals from each of FIR filters 11 and 14 is input to delays 32 and 33, respectively, and are thus delayed by 0.7 ms. One of the split output signals from each of FIR filters 11-1 and 14-1 is similarly input to delays 32-1 and 33-1, respectively, and are thus delayed by 30 ms. The delayed output signals from delays 32, 33, 32-1, 33-1, 41 and 42 and the other split output signal from each of the FIR filters 11, 14, are input to corresponding D/A converters whereby they are converted from digital to analog signals.

The output signals from D/A converters 22, 24, 22-1, 24-1 and the main signal ML(t) 2 are added by the left adder 19 and reproduced by the left channel speaker 4. The output signals from D/A converters 23, 25, 23-1, 24-1 and the main signal MR(t) 3 are added by the right adder 20 and reproduced by the right channel speaker 6. As a result, the main signal is reproduced from the front speakers as in the first embodiment above, and the surround signals with different delay times for the left (or back) and right (or back) sides of the center listener 8, second listener 8-1, and third listener 8-2 are also reproduced from the front speakers, resulting in the same effect as that achieved with the first embodiment above (provided that the apparent sound source is introduced only to the left of the second listener 8-1 and to the right of the third listener 8-2).

It will be noted that while the resulting sound image is symmetrical right and left, this configuration makes it possible to reduce the number of FIR filters required while achieving an essentially equivalent result with a simpler hardware configuration.

It is to be noted that the surround signal processed as the sound signal in this embodiment is split into four signals, and four adjustment means and four delay circuit are used to process the signals. The invention shall not be so limited, and any number of sound signal splits, adjustment means, and delay circuit may be used so long as there are at least four each.

Furthermore, this embodiment was described using two sound reproduction means, but the invention shall not be so limited and three or more sound reproduction means may also be used.

Third Embodiment

Figure 5:
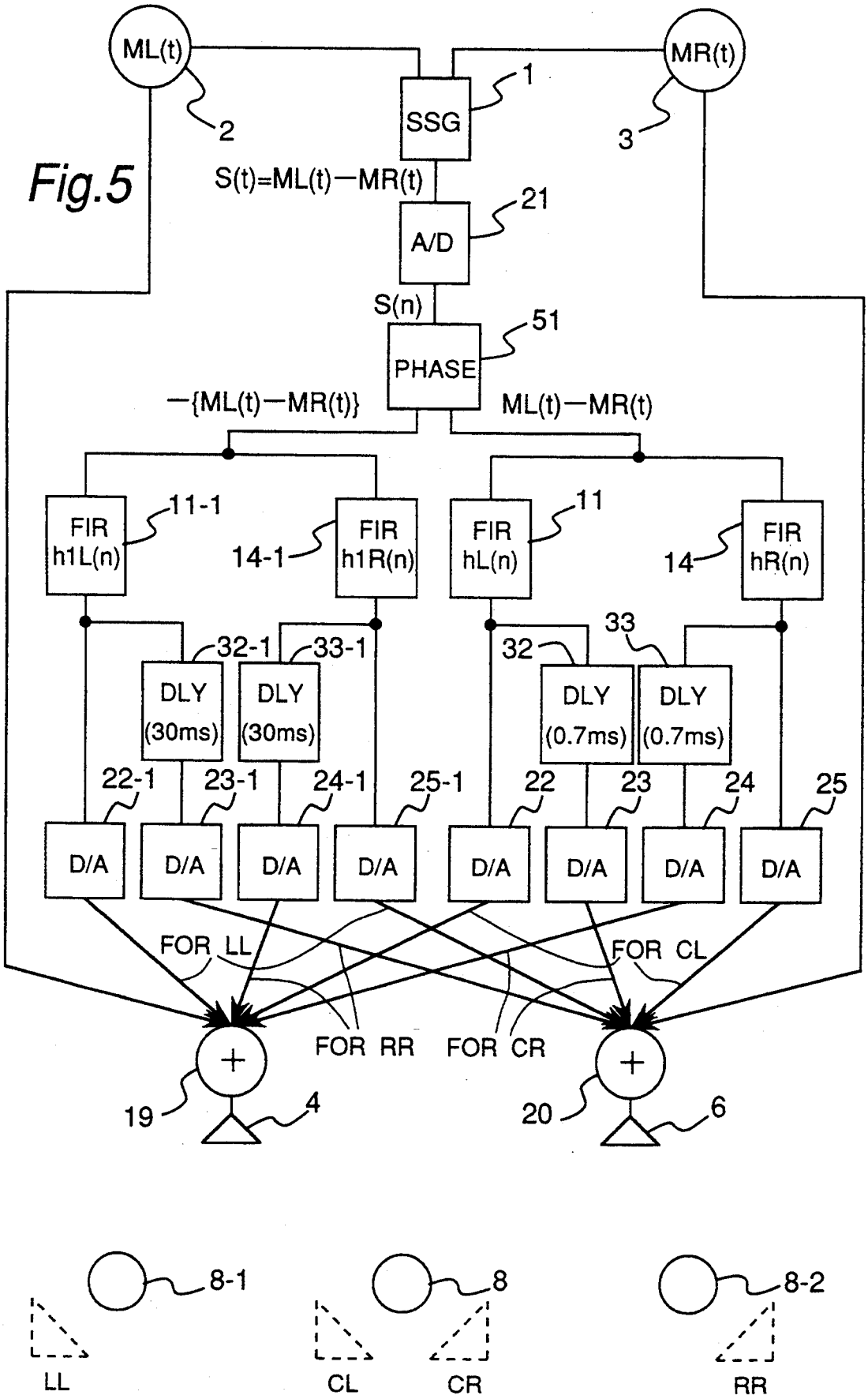
FIG. 5 is a block diagram of a sound field controller according to a third embodiment of the present invention.

FIG. 5 is a block diagram of a sound field controller according to the third embodiment of the present invention.

The third embodiment differs from the second embodiment only in the use of a phase converter 51 in place of the delay device 40 used in the second embodiment. The phase converter 51 is used as a signal generator to generate two signals of different phases (e.g., two inverse phase signals -{ML(t)-MR(t)} and ML(t)-MR(t)) from a single input signal.

The operation of the third embodiment is therefore described below with reference to FIG. 5.

The surround signal S(t) is input to the A/D converter 21, which converts the input to a digital surround signal S(n) and outputs the result to the phase converter 51.

The phase converter 51 converts the input signal S(n) to two signals of opposite phases. As described above, one way to do this is simply invert (multiply by −1) the input signal and output both the inverted input signal and the non-inverted (source) input signal. One of the phase converter 51 output signals is input to the FIR filters 11 and 14 with an impulse response characteristic hL(n) and hR(n) causing the output sound to be oriented to the left and back left of the center listener 8, and the other output signal is input to the FIR filters 11-1 and 14-1 with an impulse response characteristic h1L(n) and h1R(n) causing the output sound to be oriented to the left and back left of the second listener 8-1.

The operation thereafter is the same as that of the second embodiment, resulting in surround signals of different phases being reproduced at the left (or back) and right (or back) sides of the center listener 8, second listener 8-1, and third listener 8-2, and achieving the same effect as the first and second embodiments above.

It is to be noted that while a phase converter 51 was used in this second embodiment, any other conversion device (e.g., a device that generates two signals by adding reflected sounds of different amplitude and delay time) capable of generating two correlative but different signals from a single signal can be used to obtain the same end effect.

Note also that this embodiment was described using two sound reproduction means, but the invention shall not be so limited and three or more sound reproduction means may also be used so that sound can also be reproduced from the sides and/or back.

Figure 6:
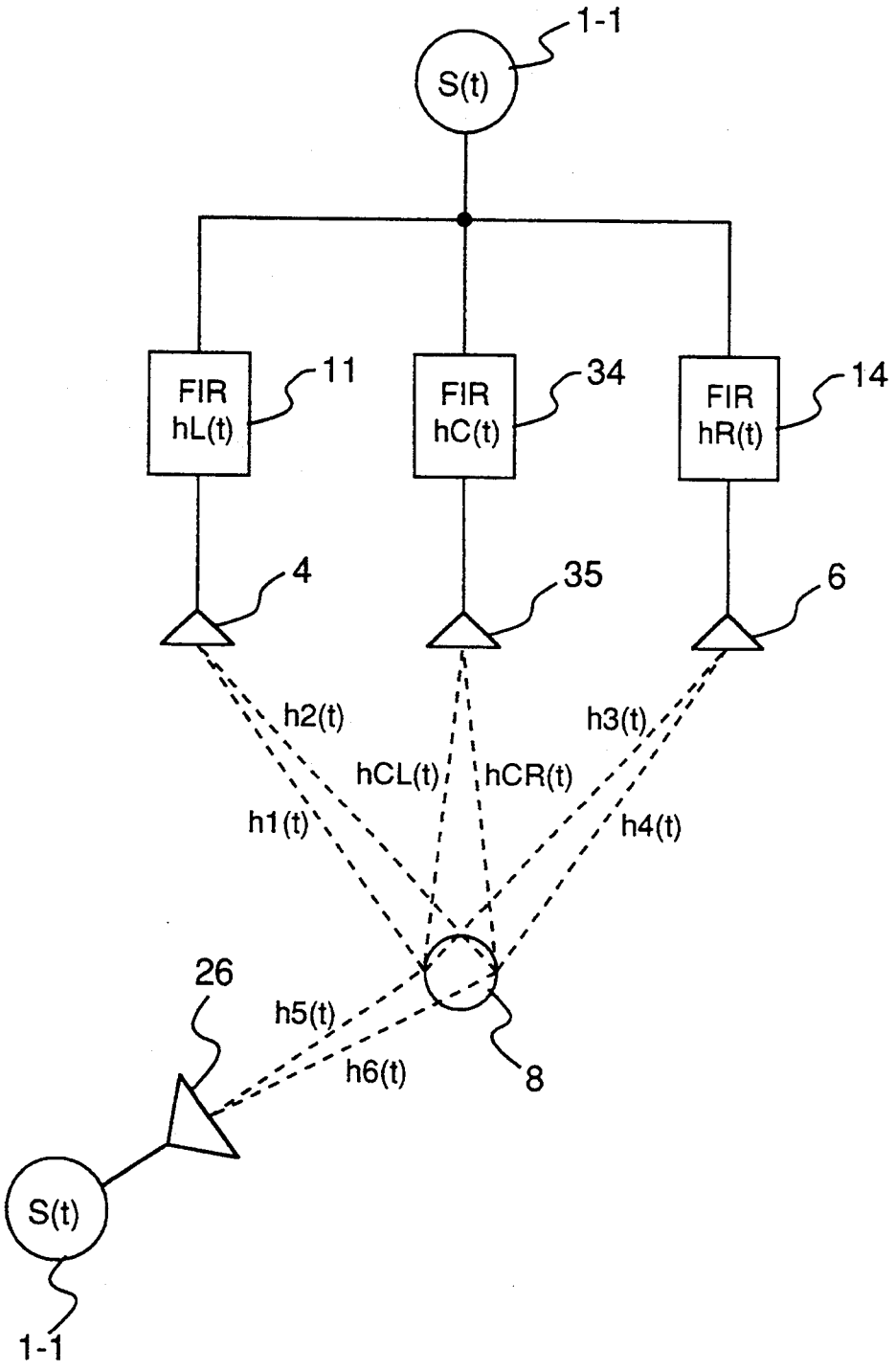
FIG. 6 is a block diagram used to describe the principle of the three speaker surround sound system.

FIG. 6 is a drawing used to describe a method of orienting the sound to the sides and back by means of three speakers. As will be understood from FIG. 6, this method also uses a center FIR filter 34 of which hC(t) is the tap coefficient (the impulse response of a time function), and a center speaker 35 positioned between the right and left speakers 4, 6 relative to the listener 8. hCL(t) and hCR(t) are the impulse response characteristics between the center speaker 35 and the left and right ears of the listener 8. All other components are the same as in FIG. 1, and are identified with like references. It should be noted, however, that the impulse response characteristics hL(t) and hR(t) of this method are different from those of the previously described method.

The significant difference between the method illustrated in FIG. 6 and that in FIG. 2 using only two speakers is the addition of the center FIR filter 34 and the center speaker 35. As in the two front speaker configuration described above, when three front speakers are used as in this configuration, the tap coefficients hL(n), hC(n), and hR(n) of the corresponding FIR filters 11, 34, and 14 must be determined so that $$L(n)=L'(n)$$
$$R(n)=R'(n)$$

where the sound reaching the left ear L'(t) and right ear R'(t) (in digital signal notation) is expressed as:

$$L'(n)=S(n)*hL(n)*h1(n)+S(n)*hC(n)*hCL(n)+S(n)*hR(n)*h3(n) \quad (11)$$

$$R'(n)=S(n)*hL(n)*h2(n)+S(n)*hC(n)*hCR(n)+S(n)*hR(n)*h4(n) \quad (12)$$

This determination is possible using a multiple channel control algorithm or other method. It is also obvious that the service area (effective listening area) of this three speaker configuration is larger than that of the two speaker configuration.

Using this principle and providing another set of FIR filters with the tap coefficients hL(n), hC(n), and hR(n), the sound signal can be processed and projected using the three front speakers 3, 35, 6 so that the sound is perceived as coming from the sides and/or back of the listeners by controlling the combination of hL(n), hR(n), hC(n), and h1L(n), h1R(n), h1C(n) characteristics (note that h1L(n) and h1R(n) are different characteristics than described above, and that h1C(n) is the impulse response for the signal output from the center speaker for the second listener) as in the first, second, and third embodiments described above. By thus providing a third speaker between the front right and left speakers, the performance of the sound field controller according to the present invention can be improved with respect to the size of the service (listening) area.

It is to be noted that the listening area can be further enlarged by further increasing the number of speakers and FIR filters used.

Fourth Embodiment

Figure 7:
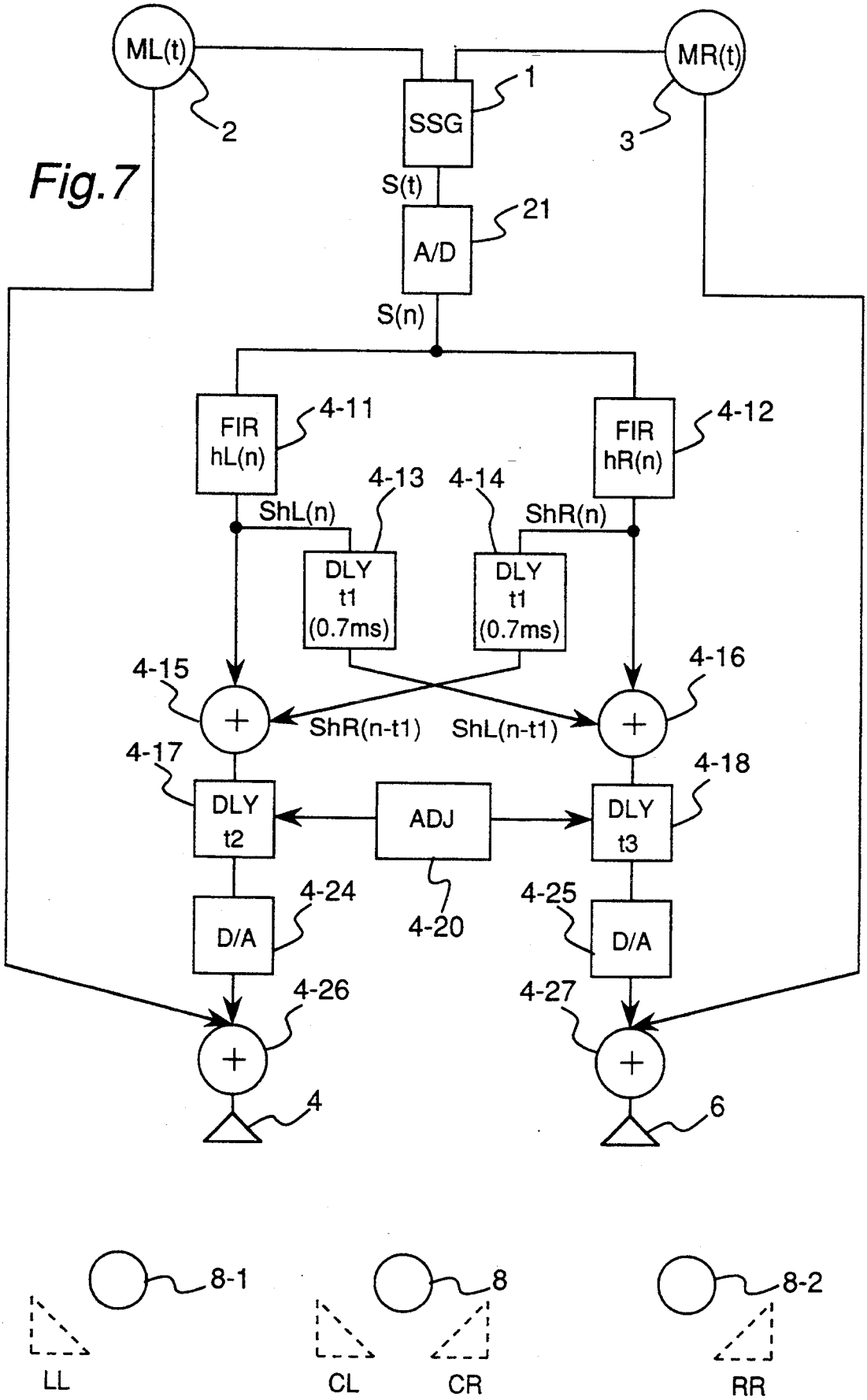
FIG. 7 is a block diagram of a sound field controller according to a fourth embodiment of the present invention.

FIG. 7 is a block diagram of a sound field controller according to the fourth embodiment of the present invention.

As in the first embodiment, it is assumed that there are three listeners, a center listener 8, a second listener 8-1 to the left, and a third listener 8-2 to the right of the center listener 8 looking towards the speakers 4 and 6. The signal ML(t) 2 to be reproduced from the left channel speaker 4 relative to the center listener 8 position, and the signal MR(t) 3 to be reproduced from the right channel speaker 6 relative to the center listener 8 position are input to the surround signal generator 1.

The surround signal generator 1 generates the surround signal S(t) containing the reverberation sound, reflected sound, and other effect sounds that are to be reproduced at a point behind the listeners by processing the two input signals ML(t) 2 and MR(t) 3.

An analog/digital (A/D) converter 21 for converting the analog surround signal S(t) to a digital signal is connected to the surround signal generator 1. The output of the A/D converter 21 is split into two signals input separately to the FIR filters 4-11 and 4-12.

The FIR filters 4-11 and 4-12 apply digital signal processing in the time domain of the head related transfer function to orient the reproduced sound to the left or left rear side of the center listener 8.

The impulse response characteristics hL(n) and hR(n) (where n is actually nT of which T is the sampling time, nT is generally expressed with the T omitted, and n is an integer greater than zero) of the FIR filters 4-11 and 4-12 are the time domain expression of the head related transfer function that orients the sound to the left or left rear side when the sound is reproduced using the two front speakers.

The output signal ShL(n) of FIR filter 4-11 is split into two signals. One of the split output signals is input directly to the same-channel adder 4-15, and the other is input through delay 4-13 to the other-channel adder 4-16. The output signal ShR(n) of FIR filter 4-12 is similarly split into two signals, one of which is input directly to the same-channel adder 4-16, and the other is input through delay 4-14 to the other-channel adder 4-15.

The delay circuits are composed of a circulating storage means such as DRAM, and function to delay the digital signals input thereto by a given time; the delay time 0.7 ms is obtained by dividing the sampling frequency.

Each of the adders 4-15, 4-16 is connected to a delay 4-17, 4-18, respectively, which is in turn connected to a discrete D/A converter 4-24, 4-25, respectively. The D/A converters convert the input digital signal to an analog signal. An adjuster 4-20 is provided to adjust the delay times t2 and t3 in a manner described later. The delay time t2 and t3 of the delays 4-17 and 4-18, respectively, causes the input digital signal to be delayed by a period determined by the adjuster 4-20, and like the delay circuit 14-13, the delay time is divided by the sampling frequency.

The adding means 4-15, 4-16 add plural input signals at a given ratio.

Each of the D/A converters 4-24, 4-25 is connected downstream to another adder 4-26, 4-27, which is in turn connected to the speakers 4, 6, respectively. The left channel signal ML(t) 2 is input with the D/A converter 4-24 output to the corresponding adder 4-26, and the right channel signal MR(t) 3 is input with the D/A converter 4-25 output to the corresponding adder 4-27.

The operation of this embodiment is described below with reference to FIG. 7.

The two-channel signal ML(t) 2, MR(t) 3 reproduced by the VCR player or other audio playback device is input to the surround signal generator 1, which generates the surround signal S(t) containing the sound reverberation, reflections, and other effects that are to be reproduced at a point behind the listeners by performing sum and difference operations on the input signals. The resulting surround signal S(t) is then converted to a digital signal S(n) by the A/D converter 21. The surround signal S(n) is then input to the FIR filters 4-11 and 4-12 of which the tap coefficient is the impulse response hL(n), hR(n) needed to orient the sound to the left or left rear sides of the center listener 8, and a convolution operation is performed.

The output signals ShL(n), ShR(n) of FIR filters 4-11 and 4-12 are split into two signals each. One of the split output signals is input directly to the same-channel adder 4-15, 4-16, and the other is input to a delay 4-13, 4-14, delayed by time t1, and then input to the other-channel adder 4-16, 4-15. The adders 4-15, 4-16 add the respective input signals at a constant ratio.

The result of this cross-channel delay is that the delayed signal is the opposite channel version of the undelayed signal. As a result, the sound is oriented to the left (or back) of the center listener 8 by the undelayed signals ShL(n) and ShR(n), and sound is also oriented to the right (or rear) at t1 after the sound heard on the left (or rear) of the center listener 8 by the delayed cross-channel signals ShR(n-t1) and ShL(n-t1).

By thus applying a time delay to each of the signals (i.e., between ShL(n) and ShL(n-t1), and between ShR(n) and ShR(n-t1)), the signals orienting sound to the left and right (or rear) of the listener can be separated, and the sound presence to the sides or rear of the listeners can be made clearer. For example, because the normal surround signal is a monaural signal, the sound image will be located between the two output devices when left and right output devices (speakers) are driven simultaneously without applying a time difference to the right and left channel signals. The delay circuit 4-13 and 4-14 are needed to avoid this. (An appropriate delay time is approximately 10 msec).

After processing the signal to orient the sound to the left and right sides of the center listener 8, the signals are further delayed by delays 4-17 and 4-18 by delay times t2 and t3. If adjuster 4-20 is so adjusted to set $t2=t3$ the sound image will be best for the center listener 8 with the sound oriented symmetrically. If adjuster 4-20 is so adjusted to set $t2>t3$ the sound image will be best for the second listener 8-1, and if it is so adjusted to set $t2<t3$ the sound image will be best for the third listener 8-2.

By thus applying a time difference using these second delays 4-17 and 4-18, the sound image can be oriented to the both sides (or back) of listeners other than the center listener 8. (The difference between t2 and t3 is preferably less than 1 msec).

The delayed signals are then input from the delays 4-17 and 4-18 to the D/A converters 4-24, 4-25, respectively, and converted from digital to analog signals. The converted signals are input with the main signals ML(t) 2 and MR(t) 3 to the adders 4-26, 4-27, respectively, added, and output through the speakers 4, 6, respectively. The sound reproduced by the speakers 4, 6 can be modified for enhanced ambiance, realism, or to match listener preferences by changing the ratio used by the adders 4-26, 4-27 when adding the main signals ML(t) 2 and MR(t) 3 and the processed surround signal S(t) from the D/A converters 4-24, 4-25.

As thus described, sound can be projected so that it is perceived as coming from the right and left sides or back of the listener using only two FIR filters 4-11 and 4-12 which process the surround signal S(t) to orient the sound to the left (or rear) of a single listener 8, delaying the output from the FIR filters 4-11 and 4-12, and then adding the delayed opposite-channel FIR filter output with the undelayed same-channel FIR filter output. Note that this effect is achieved without using a FIR filter to orient the sound to the right or rear of the listener.

In addition, by adjusting the delay time of the added FIR filter signals, the sound image can also be oriented to the sides (or back) of another listener 8-1 or 8-2 without using additional FIR filters 4-11, 4-12 to process the signal for this additional listener 8-1 or 8-2. Sound effects with even greater ambiance can also be reproduced in combination with the main signals.

It is to be noted that a surround signal was used as the sound signal in this embodiment, and the amplitude and delay time of the surround signal were adjusted by an adjuster 4-20 so that the sound would be perceived by the listener(s) as coming from the sides or back of the listener position when reproduced through speakers located in front of the listener(s). The invention shall not be so limited, however, and the invention can also be used as a device that uses a commonly recorded audio signal as the sound signal and projects a sound image that is heard at any given position regardless of the location of the sound reproduction means (speakers) by adjusting the amplitude and delay time of the sound signal so that the sound reproduced by speakers will be perceived as coming from a location other than the position of the speakers.

Furthermore, while the main signals ML(t) 2, MR(t) 3, and the amplitude- and delay time-adjusted surround signal S(t) are added by the adders 4-26 and 4-27, and the resulting sum signals are reproduced by the speakers, it is also possible to reproduce the main signals ML(t) 2, MR(t) 3 from separate speakers.

In addition, adjuster for adjusting delay time of two delays 4-17 and 4-18 were used in this embodiment, but is obviously also possible to split the sound signal into three or more signals using the signal splitting means, process these split signals with three or more adjusters, and reproduce the signals with three or more speakers.

Fifth Embodiment

Figure 8:
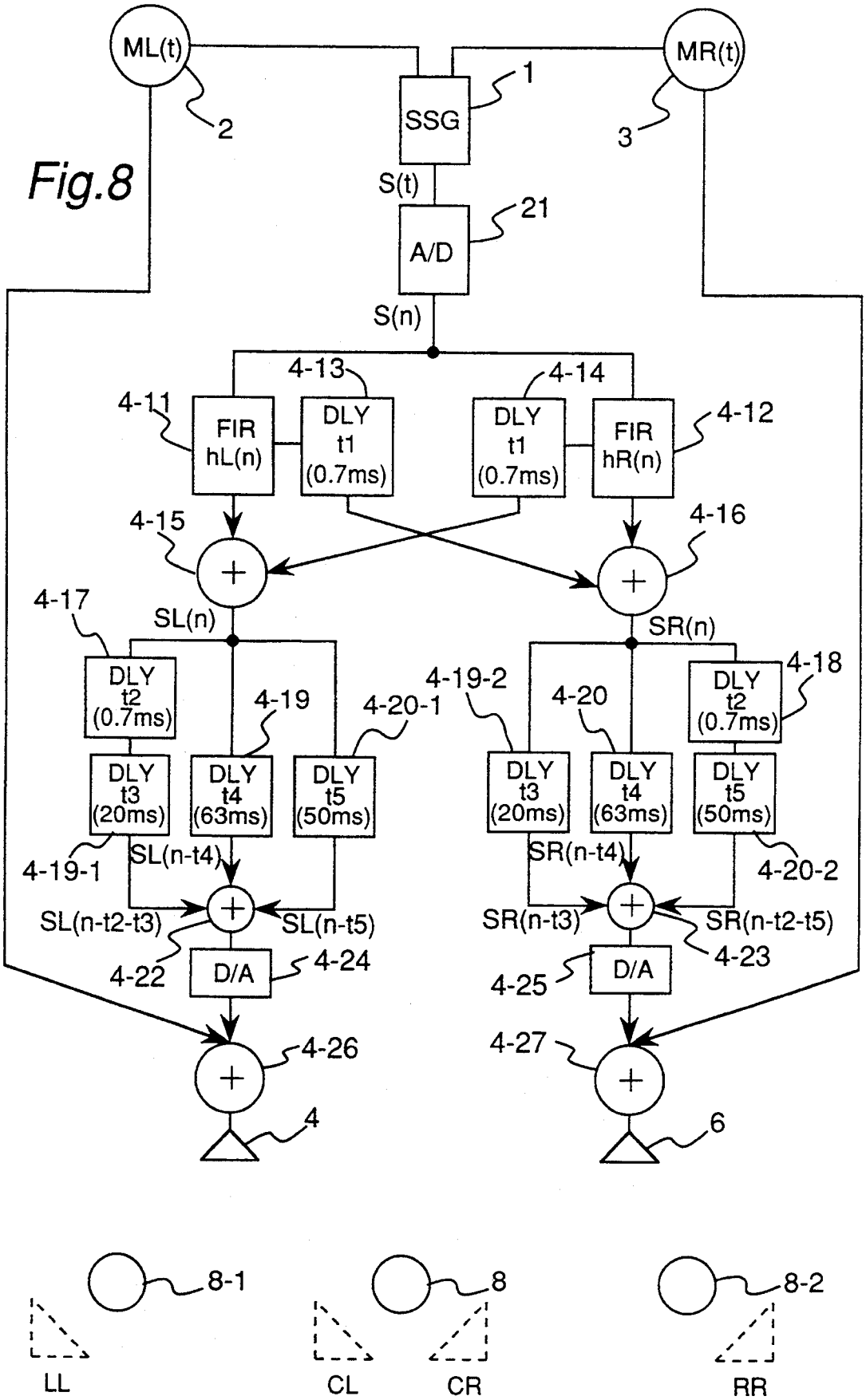
FIG. 8 is a block diagram of a sound field controller according to a fifth embodiment of the present invention.

FIG. 8 is a block diagram of a sound field controller according to the fifth embodiment of the present invention.

This fifth embodiment differs from the fourth embodiment shown in FIG. 7 is the addition, between the first adders 4-15, 4-16 and the D/A converters 4-24, 4-25, of delays 4-17, 4-19-1, 4-19, 4-20-1, 4-18, 4-20-2, 4-20, and 4-19-2 to add a time difference and delay the adder 4-15, 4-16 output signals, and adders 4-22, 4-23 to add the delay output signals at a given ratio.

The operation of this embodiment is described below with reference to FIG. 8.

The surround signal S(t) generated as described in the fourth embodiment above is input to the A/D converter 21 and converted to a digital signal S(n). The digitized surround signal S(n) is then split and input to the FIR filters 4-11 and 4-12 of which the tap coefficient is the impulse response hL(n), hR(n) needed to orient the sound to the left or rear sides of the center listener 8. The signals processed by the FIR filters 4-11 and 4-12 are split in two signals each. One of the split output signals is input directly to the same-channel adder 4-15, 4-16, and the other is input to a delay 4-13, 4-14, delayed by time t1, and then input to the other-channel adder 4-16, 4-15. This is the same operation as in the fourth embodiment. As a result, the sound can be oriented to the sides (or rear) of the center listener 8 by outputting the adder 4-15, 4-16 output signals SL(n), SR(n) from the speakers 4, 6.

The adder 4-15, 4-16 output signals SL(n), SR(n) are then split into three signals each, input to the delays 4-17, 4-18, 4-19, 4-19-1, 4-19-2, 4-20, 4-20-1, and 4-20-2, and respectively delayed by t2+t3, t4, t5, t3, t4, t2+t5.

The sound is oriented to the sides (or back) of the second listener 8-1 by outputting delayed signals SL(n-t2-t3) and SR(n-t3) from the speakers 4, 6, to the sides (or back) of the third listener 8-2 by outputting delayed signals SL(n-t5) and SR(n-t2-t5) from the speakers 4, 6, and to the sides (or back) of the center listener 8 by outputting delayed signals SL(n-t4) and SR(n-t4) from the speakers 4, 6.

While the length of delay t2 is preferably increased as the distance between the side listeners 8-1 and 8-2 and the center listener 8 increases, t2 should normally be less than approximately 1 msec. In addition, the best sound image (the sound oriented to the sides (or back) of each of the listeners) for each of the listeners 8, 8-1 and 8-2 can be separated by adjusting the delays t3, t4, and t5. Delay t4 is preferably at least 15 msec less than t3 and t5, and there is preferably a difference of approximately 20 msec between t3 and t5. In the embodiment shown in FIG. 8, delay times t1, t2, t3, t4 and t5 are 0.7 ms, 0.7 ms, 20 ms, 63 ms and 50 ms, respectively.

Signals SL(n-t2-t3), SL(n-t4), and SL(n-t5) are added at any desired ratio by adder 4-22, and signals SR(n-t3), SR(n-t4), and SR(n-t2-t5) are added at any desired ratio by adder 4-23. If, for example, the ratio of signals SL(n-t4) and SR(n-t4) to the other signals in the sum signal is high, deterioration of the sound heard by the center listener 8 can be prevented. This is because the signals locating the sound to the left or right side of the center listener 8 are the same signals locating the sound in front of the second listener 8-1 and third listener 8-2, and sounds located to the left or right sides of the second and third listeners will be perceived as being located in front of the center listener 8. As described previously, this is avoided by adjusting the delay time of the delay circuit 4-19, 4-19-1, 4-19-2, 4-20, 4-20-1, 4-20-2.

The outputs from the adders 4-22, 4-23 are then input to the D/A converters 4-24, 4-25, and converted from digital to analog signals. The converted signals are input with the main signals ML(t) 2 and MR(t) 3 to the adders 4-26, 4-27, respectively, added, and output through the speakers 4, 6, respectively. As a result, the main signals are reproduced as sound from the front as in the first embodiment above, and the surround signal is reproduced as sound from the left (or back) and right (or back) sides relative to the center listener 8, second listener 8-1, and third listener 8-2, and the same effect is obtained as in the third embodiment.

As thus described, surround sound can be projected so that it is perceived as coming from the right and left sides or back of plural listeners 8, 8-1, 8-2 by using only two FIR filters which process the surround signal S(t) to orient the sound to the left and right sides (or rear) of a single listener 8, delaying the output from the FIR filters, and then adding the delayed signals. Note that this effect is achieved without using a FIR filter to orient the sound to the sides or rear of the other listeners.

With this configuration, it not only possible to limit the number of FIR filters to the number of speakers, but good sound effects can be achieved with a simple configuration throughout a broad listening area.

In addition, while the signals SL(n) and SR(n) were split into three signals each in this embodiment, the invention shall not be so limited. The signals SL(n) and SR(n) can be split into four or more signals each by providing a delay circuit for each signal, and the delay time of each delay circuit may be adjusted to optimize the sound output for four or more listeners.

Furthermore, this embodiment was described with two speakers located in front of the listeners, but more than two speakers can be used to project sound from the sides or back of the listeners.

Sixth Embodiment

Figure 9:
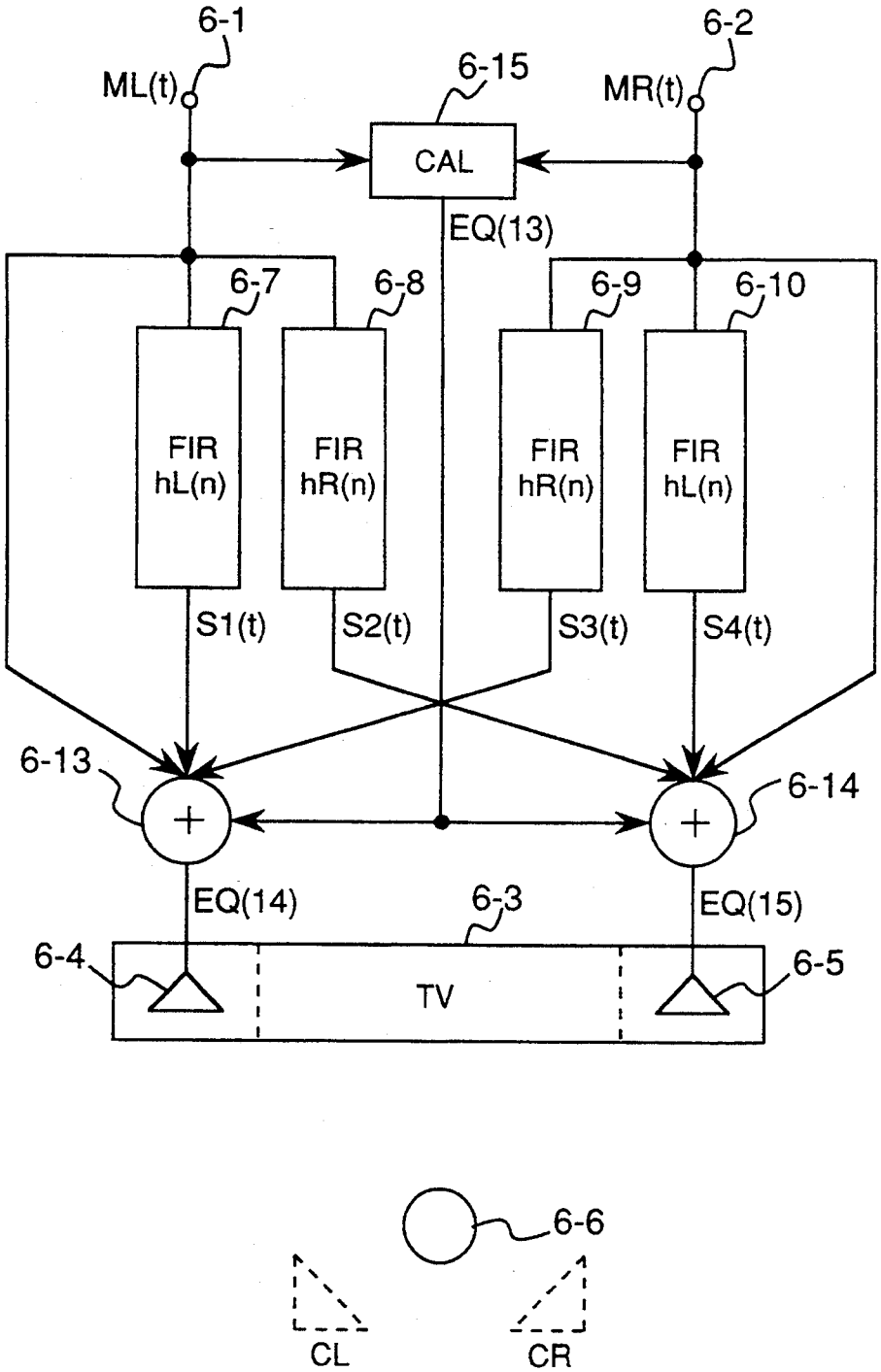
FIG. 9 is a block diagram of a sound field controller according to a sixth embodiment of the present invention.

FIG. 9 is a block diagram of a sound field controller according to the sixth embodiment of the present invention.

Referring to FIG. 9, when the sound signal obtained by demodulating a broadcast signal or from packaged media such as a video tape is a stereo signal in this embodiment, the left channel signal is input to the left channel input terminal 6-1 and the right channel signal is input to the right channel input terminal 6-2. When the input signal is a monaural signal, the signal is split in two and input to both input terminals 6-1 and 5-2. The input terminals 6-1 and 6-2 input the signal to the calculation circuit 6-15, which obtains the sum and difference of the signals and the ratio between the sum and difference signals to control the adding ratio in the adders 6-13, 6-14.

The adders 6-13, 6-14 output to the left and right channel built-in speakers 6-4, 6-5 of the television 6-3, which is in front of the viewer 6-6. The viewer 6-6 is assumed to be centered between the two speakers 6-4, 6-5.

The left channel FIR filters 6-7 and 6-8 process the signal input to the left channel input terminal 6-1 to introduce apparent sound source CL so as to orient the sound image to the left side of the viewer 6-6. The right channel FIR filters 6-9 and 6-10 process the signal input to the right channel input terminal 6-2 to introduce apparent sound source CR so as to orient the sound image to the right side of the viewer 6-6.

The output signals S1(t), S2(t), S3(t), S4(t) from the FIR filters 6-7, 6-8, 6-9, and 6-10, respectively, are input to the adders 6-13, 6-14, which add three of the input signals at a specific ratio.

The operation of this embodiment is described below with reference to FIG. 9.

The two channel signals ML(t) and MR(t) obtained by reproducing or demodulating the sound track from a video tape or broadcast signal are input through the input terminals 6-1 and 6-2 to the FIR filters 6-7, 6-8, 6-9, and 6-10, adders 6-13, 6-14, and calculation circuit 6-15. As described above, the FIR filters 6-7, 6-8, 6-9, and 6-10 process the input signals to orient the sound image to the sides of the listener. The evaluation circuit 6-15 processes the equation $$\alpha=|ML(t)-MR(t)|/|ML(t)+MR(t)| \quad (13)$$

and controls the ratio of the summation performed by the adders 6-13, 6-14 based on the obtained value $\alpha$. When the input signal is a monaural or near-monaural signal, the numerator of this equation will be zero or nearly zero, and the value $\alpha$ will therefore also be nearly zero. When a stereo signal (a signal with little correlation between ML(t) and MR(t)) is input, the numerator will be large and the value $\alpha$ will therefore also be large.

The adders 6-13, 6-14 perform the following summations:

$$SL(t)=ML(t)\cdot(1-\alpha)+(S1(t)+S3(t))\cdot\alpha \quad (14)$$

$$SR(t)=MR(t)\cdot(1-\alpha)+(S2(t)+S4(t))\cdot\alpha \quad (15)$$

where $\alpha$ may be the value obtained by equation (13) but is normally converted to a value between 0–1. Note also that the value of $\alpha$ can be changed to control the stereo expansion. In addition, while ML(t) and MR(t) are multiplied by $(1-\alpha)$, this prevents the total volume SL(t), SR(t) from changing with the change in $\alpha$, and multiplication by $(1-\alpha)$ is not necessarily required (i.e., multiplication is not necessary if it does not matter if the volume changes).

Furthermore, updating the value of $\alpha$ should only be performed after waiting a certain interval because updating $\alpha$ could disrupt the obtained sound effect depending on the update timing.

The adders 6-13, 6-14 may also perform the following summations instead of those in equation (14) and (15).

$$SL(t)=ML(t)\cdot(1-A)+(S1(t)+S3(t))\cdot A \quad (16)$$

$$SR(t)=MR(t)\cdot(1-A)+(S2(t)+S4(t))\cdot A \quad (17)$$

where

IF $\alpha_N>\alpha_{N-1}$, THEN $A=(A+\Delta A)$
IF $\alpha_N<\alpha_{N-1}$, THEN $A=(A-\Delta A)$
ELSE $A=A$ and the subscript to $\alpha$ is the calculated passage of time.

What these equations mean is that if the current calculated value of $\alpha$ is greater than the previously calculated value of $\alpha$, increase the value of A by a constant $\Delta A$ and obtain equations (16) and (17). If the opposite is true (the current $\alpha$ is less than the previous $\alpha$), decrease the value of A by a constant $\Delta A$ and obtain equations (16) and (17). Note that the value $\Delta A$ may be a constant as above or a non-linear value. When comparing the current and previous $\alpha$ values, a tolerance may also be used for the operation. This is also to avoid the disruption of the sound effect caused by the timing of $\alpha$ updating.

By outputting SL(t) and SR(t) from the speakers 6-4, 6-5 after completing this operation, the volume of the signal oriented to the left and right sides of the viewer can be controlled based on whether the input signal is a stereo or monaural signal, and distortion of the sound image and deterioration of sound quality when the input signal is a monaural signal can be prevented.

Seventh Embodiment

Figure 10:
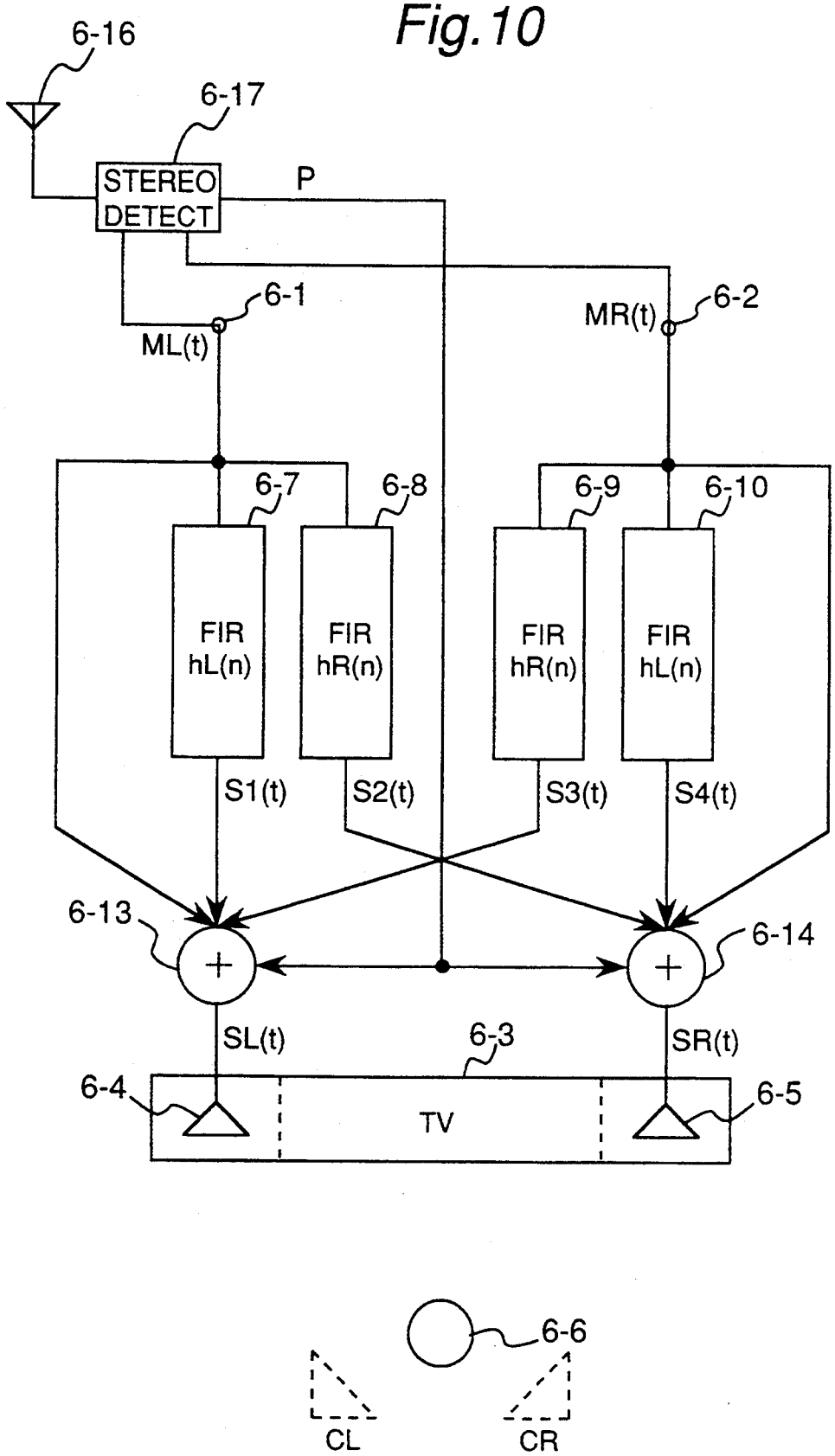
FIG. 10 is a block diagram of a sound field controller according to a seventh embodiment of the present invention.

FIG. 10 is a block diagram of a sound field controller according to the seventh embodiment of the present invention. This embodiment differs from the sixth embodiment in the antenna 6-16 used to receive the television broadcast signal, the stereo detector 6-17, and the control signal P, which determines whether the audio signal is a stereo or multiplex (e.g., bilingual broadcast) signal. The other components functionally identical to the same components in the sixth embodiment are identified by the same references.

The operation of this embodiment is described below with reference to FIG. 10.

The broadcast signal is received by the antenna 6-16 and input to the stereo detector 6-17. The stereo detector 6-17 demodulates the audio signal and extracts the control signal P, which controls whether the broadcast signal is a stereo or multiplex signal. The extracted control signal P is then output to the adders 6-13, 6-14.

As described above, the FIR filters 6-7, 6-8, 6-9, and 6-10 process the respective input signals to orient the sound to the sides of the listener.

The adders 6-13, 6-14 perform the following summations on the FIR filter 6-7, 6-8, 6-9, and 6-10 output signals and the main input signal ML(t), MR(t).

$$SL(t)=ML(t)\cdot(1-B)+(S1(t)+S3(t))\cdot B \quad (18)$$

$$SR(t)=MR(t)\cdot(1-B)+(S2(t)+S4(t))\cdot B \quad (19)$$

where

IF P=STEREO, THEN B=0.5
ELSE B=0

What these equations mean is that if the control signal P indicates a stereo audio signal, the equations are processing using a value of B=0.5, otherwise a value of B=0 is used. Note also that while B is defined as a constant value of B=0.5 above, the value of B can be changed to control the stereo expansion. For example, if it does not matter if the volume changes, (1−B) can be multiplied by ML(t) and MR(t), and B may be alternatively defined as values of 0 and 2 rather than 0 and 0.5 as above.

By outputting SL(t) and SR(t) from the speakers 6-4, 6-5 after completing this operation, the volume of the signal oriented to the left and right sides of the viewer can be switched between 0 and 1 (or infinity) based on whether the input signal is a stereo or monaural signal, and distortion of the sound image and deterioration of sound quality when the input signal is a monaural signal can be prevented.

Furthermore, this embodiment was described with two speakers located in front of the viewer, but more than two speakers can be used to project sound from the sides of the viewer.

Eight Embodiment

Figure 11:
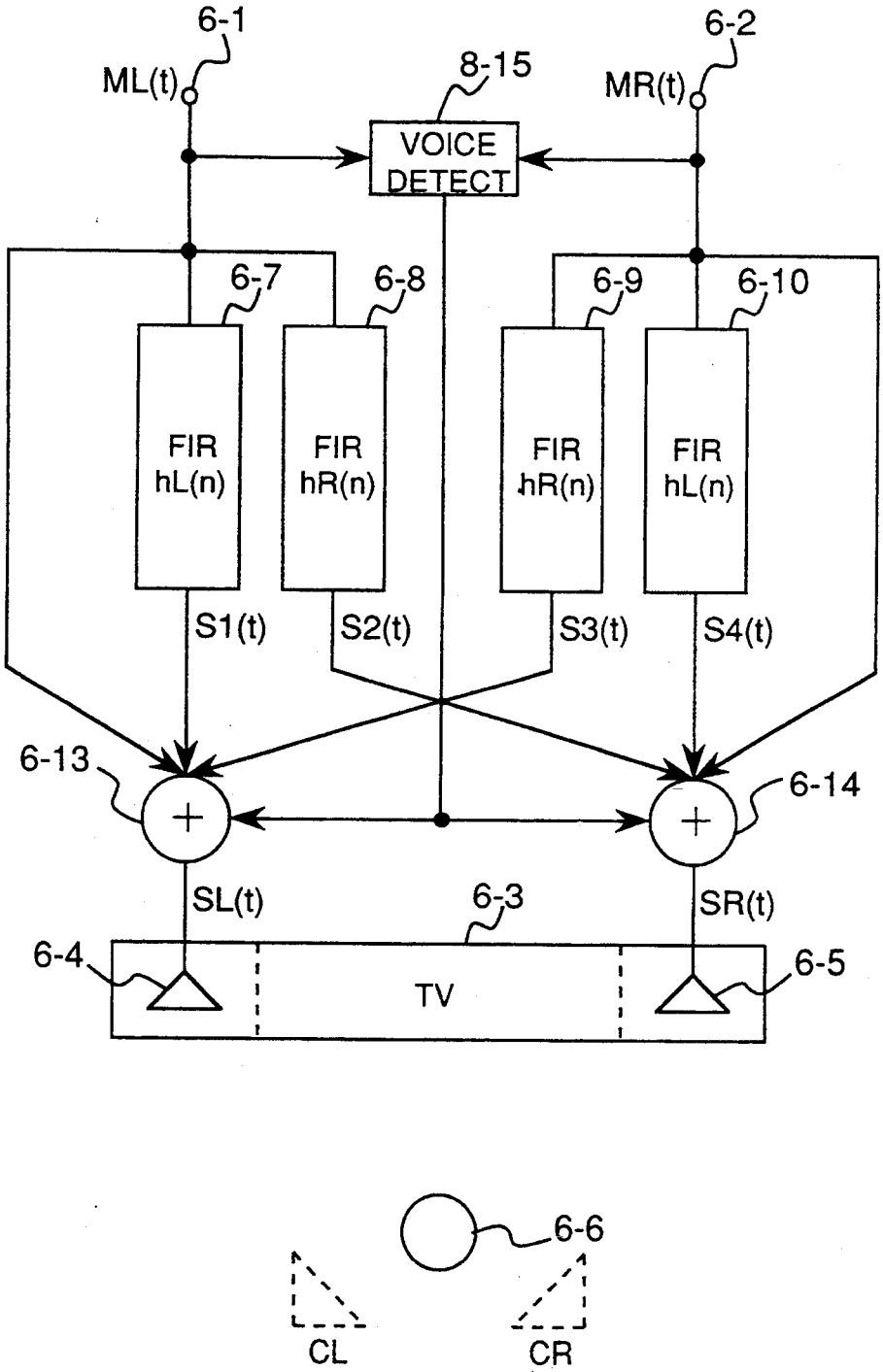
FIG. 11 is a block diagram of a sound field controller according to an eighth embodiment of the present invention.

FIG. 11 is a block diagram of a sound field controller according to the eighth embodiment of the present invention.

This embodiment differs from that shown in FIG. 10 in the use of a voice detector 8-15. The voice detector 8-15 obtains the sum of the two input signals, detects the frequency of blank periods (where the signal is essentially zero) in the sum signal, evaluates whether the input signal is or is not a voice signal based on the frequency of signal blanks, and controls the sun, nation ratio of the adders 6-13, 6-14 accordingly. The other components functionally identical to the same components in the seventh embodiment are identified by the same references.

The operation of this embodiment is described below with reference to FIG. 11.

The two channel signals ML(t), MR(t) obtained by playing back a video tape or demodulating a broadcast signal are input through the input terminals 6-1 and 6-2 to the FIR filters 6-7, 6-8, 6-9, and 6-10, adders 6-13, 6-14, and voice detector 8-15.

As in the sixth embodiment above, the FIR filters 6-7, 6-8, 6-9, and 6-10 process the respective input signals so that the sound image projected by the speakers is perceived as coming from the sides of the listener as though speakers were physically placed at the sides.

The voice detector 8-15 then obtains the such of the two input signals, and measures the frequency of blank periods in the sum signal within a limited time period.

Figure 12A:
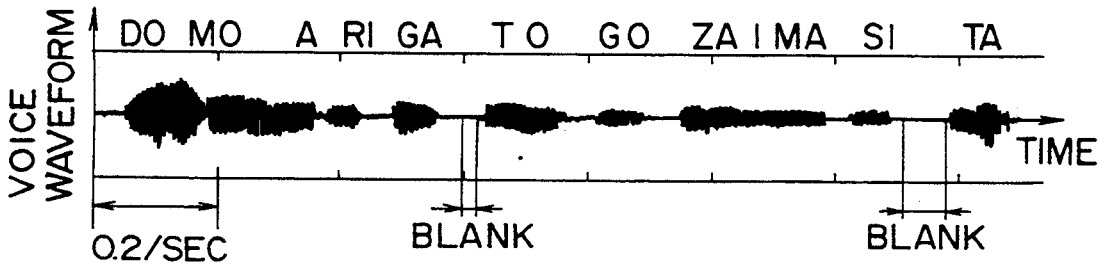
FIG. 12*a* is graph showing voice waveform to describe the properties of the sound signal.

FIG. 12*a* shows a voice waveform used to describe the properties of the sound signal. Time is shown along the horizontal axis, and amplitude along the vertical axis of this graph. This sound wave was obtained for the spoken words "DOMO ARIGATO GOZAIMASHITA" (Thank you very much) in Japanese. As will be known from this graph, there will always be a certain number of blanks (silent periods) within a certain period of time in a voice signal (in this example there are one or two blanks in a 1 second period). The voice detector 8-15 uses this property to determine whether the input signal is a voice signal or a non-voice audio signal, and controls the summation ratio of the adders 6-13, 6-14 based on this blank period frequency.

Note that updating the summation ratio of the adders should only be performed after waiting a certain interval because updating the ratio could disrupt the obtained sound effect depending on the timing of the blank frequency measurement and resulting update.

The adders 6-13, 6-14 may use the following summation method.

$$SL(t)=ML(t)\cdot(1-A)+(S1(t)+S3(t))\cdot A \quad (20)$$

$$SR(t)=MR(t)\cdot(1-A)+(S2(t)+S4(t))\cdot A \quad (21)$$

where

If the input signal is not a voice signal, $$A=(A+\Delta A) \quad (22)$$

is selected, and if the input signal is a voice signal, $$A=(A-\Delta A) \quad (23)$$

is selected.

What these equations mean is when the input signal is determined to not be a voice signal, increase the value of A is by a constant ΔA to obtain equations (20) and (21). When the input signal is determined to be a voice signal, decrease the value of A by a constant ΔA and obtain equations (20) and (21). This operation is successively repeated at a predetermined interval. Note that the value ΔA may be a constant as above or a non-linear value. By constantly repeating this evaluated, it is possible to prevent any significant effect on the output when an evaluation error is made by the voice detector 8-15.

Figure 12B:
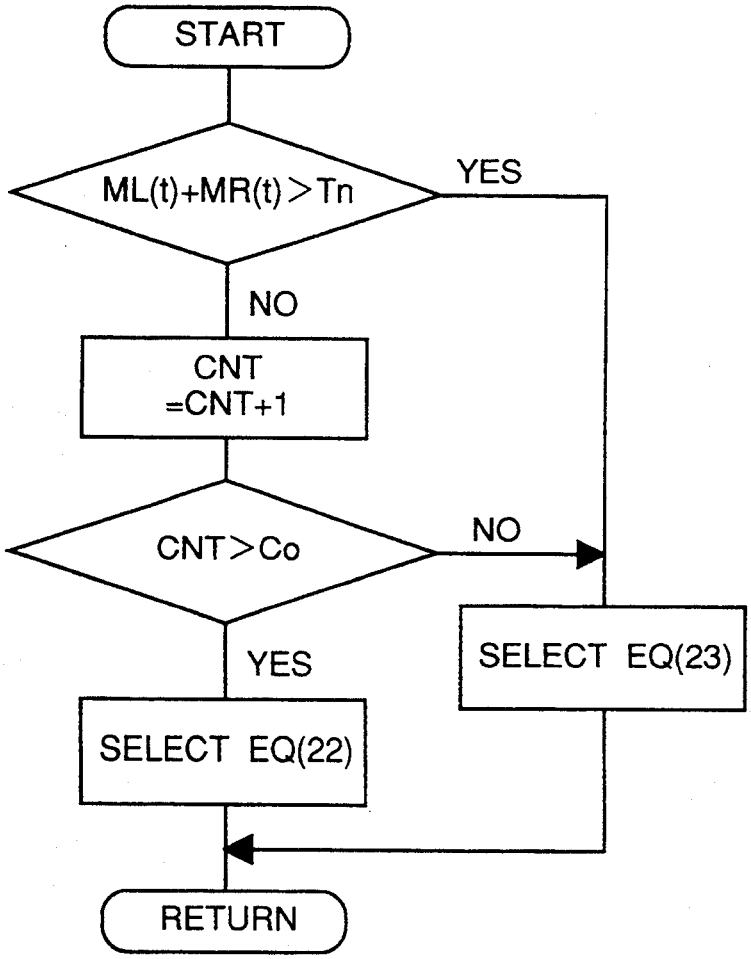
FIG. 12*b* is a flow chart showing steps to select either one of equation (22) or (23).

FIG. 12*b* shows a flow chart of the operation carried out in the voice detector 8-15 and adders 6-13, 6-14. First, it is detected whether or not the sum ML(t)+MR(t) is greater than a predetermined threshold Th. If NO, a blank is detected to increment the count CNT, but if YES, equation (23) is selected. Then, it is detected whether or not the counted value CNT is greater than a predetermined value C0. If YES, equation (22) is selected, but IF NO, equation (23) is selected.

By outputting SL(t) and SR(t) from the speakers 6-4, 6-5 after completing this operation, the volume of the signal oriented to the left and right sides of the viewer can be controlled based on whether the input signal is a voice or non-voice signal. Because the sound from the apparent sound sources CL and CR increases and stereo separation increases when the input signal is a non-voice signal, and decreases when the input signal is a voice signal, normal audio reproduction is obtained, and reduced voice articulation and deteriorated sound quality can be prevented.

It is to be noted that while the determination of a voice or non-voice audio input signal by the voice detector 8-15 is based on the frequency of signal blanks as described above, this evaluation can also be based on the slope of the envelope of input signal highs and lows, or a combination of these two methods can also be used.

In addition, while the voice detector 8-15 obtained the sum of the input signals for this evaluation, each of the input signals can also be separately evaluated without obtaining their sum signal.

Furthermore, this embodiment was described with two speakers located in front of the viewer, but more than two speakers can be used to project sound from the sides of the viewer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sound field controller for controlling a sound field by left and right speakers provided in front of one or more listeners, comprising:

input means for providing first and second sound signals;

left sound pattern generating means for generating a left sound pattern signal;

right sound pattern generating means for generating a right sound pattern signal;

first adding means for adding said first sound signal, said left sound pattern signal and said right sound pattern signal and applying the added signal to said left speaker;

second adding means for adding said second sound signal, said right sound pattern signal and said left sound pattern signal and applying the added signal to said right speaker; and weight control means for controlling a weight for adding said first and second sound signals by calculating a degree of difference between said first and second sound signals, and using the calculated degree of difference in said first and second adding means to decrease the weight of adding said first and second sound signals as the degree of difference becomes great.

2. A sound field controller for controlling a sound field by left and right speakers provided in front of one or more listeners, comprising:

surround signal generator means for receiving first and second signals and generating a one sound signal which is commensurate with a difference between said first and second signals;

left sound pattern generating means for generating a left sound pattern signal from said one sound signal;

right sound pattern generating means for generating a right sound pattern signal from said one sound signal;

first delay means for delaying said left and right sound pattern signals by a first predetermined time and applying a first delayed left sound pattern signal and a first delayed right sound pattern signal to said left and right speakers, respectively, to introduce an apparent sound source located left rear of a center listener; and second delay means for delaying said left and right sound pattern signals by a second predetermined time, said second predetermined time being not equal to said first predetermined time, and applying a second delayed left sound pattern signal and a second delayed right sound pattern signal to said right and left speakers, respectively, to introduce an apparent sound source located right rear of a center listener.

3. A sound field controller as claimed in claim further comprising:

further-left sound pattern generating means for generating a further-left sound pattern signal;

further-right sound pattern generating means for generating a further-right sound pattern signal;

third delay means for delaying said further-left and further-right sound pattern signals by third and fourth predetermined times, respectively, and applying the delayed further-left and further-right sound pattern signals to said left and right speakers, respectively, to introduce an apparent sound source located left rear of a left listener; and fourth delay means for delaying said further-left and further-right sound pattern signals by said fourth and third predetermined times, respectively, and applying the delayed further-left and further-right sound pattern signals to said right and left speakers, respectively, to introduce an apparent sound source located right rear of a right listener.

4. A sound field controller for controlling a sound field by left and right speakers provided in front of one or more listeners, comprising:

surround signal generator means for receiving first and second signals and generating a one sound signal which is commensurate with a difference between said first and second signals;

left sound pattern generating means for generating a left sound pattern signal from said one sound signal;

right sound pattern generating means for generating a right sound pattern signal from said one sound signal;

first delay means for delaying said left and right sound pattern signals by a first predetermined time;

first adding means for adding said left sound pattern signal and the delayed right sound pattern signal and producing a first added signal;

second adding means for adding said right sound pattern signal and the delayed left sound pattern signal and producing a second added signal;

second delay means for delaying said first added signal by a second time and applying the delayed first added signal to said first speaker; and third delay means for delaying said second added signal by a third time and applying the delayed second added signal to said second speaker, whereby apparent sound sources are introduced at left and right rear sides of a listener.

5. A sound field controller as claimed in claim 4, further comprising adjusting means for adjusting said second and third times to change the locations of apparent sound sources located left and right rear sides of a listener.

6. A sound field controller as claimed in claim 4, further comprising:

fourth delay means for delaying said first added signal by a fourth time and applying the fourth time delayed first added signal to said first speaker;

fifth delay means for delaying said second added signal by a fifth time and applying the fifth time delayed second added signal to said second speaker, whereby apparent sound sources are introduced at the left and right rear sides of a listener at another location.

7. A sound field controller for controlling a sound field by left and right speakers provided in front of one or more listeners, comprising:

input means for providing first and second sound signals;

left sound pattern generating means for generating a left sound pattern signal;

right sound pattern generating means for generating a right sound pattern signal;

first adding means for adding said first sound signal, said left sound pattern signal and said right sound pattern signal and applying the added signal to said left speaker;

second adding means for adding said second sound signal, said right sound pattern signal and said left sound pattern signal and applying the added signal to said right speaker; and stereo detector for controlling a weight for adding said first and second sound signals by detecting said first and second sound signals as stereo signals or signals other than the stereo signals, and using the detected result to decrease the weight of adding said first and second sound signals when the first and second signals are detected as the stereo signals.

8. A sound field controller for controlling a sound field by left and right speakers provided in front of one or more listeners, comprising:

input means for providing first and second sound signals;

left sound pattern generating means for generating a left sound pattern signal;

right sound pattern generating means for generating a right sound pattern signal;

first adding means for adding said first sound signal, said left sound pattern signal and said right sound pattern signal and applying the added signal to said left speaker;

second adding means for adding said second sound signal, said right sound pattern signal and said left sound pattern signal and applying the added signal to said right speaker; and voice detector means for controlling a weight of adding said first and second sound signals by detecting said first and second sound signals as voice signals or signals other than the voice signals, and using the detected result to increase the weight of adding said first and second sound signals when the first and second signals are detected as the voice signals.

* * * * *

UNITED STATES PATENT AND TRADEMARK OFFICE

CERTIFICATE OF CORRECTION

PATENT NO. : 5,381,482
DATED : January 10, 1995
INVENTOR(S) : Matsumoto et al.

It is certified that error appears in the above-identified patent and that said Letters Patent is hereby corrected as shown below:

Column 21, line 52, after "claim" insert --2--.

Signed and Sealed this

Sixteenth Day of May, 1995

*Attest:*

*Attesting Officer*

BRUCE LEHMAN

*Commissioner of Patents and Trademarks*